US011633313B2

(12) United States Patent
Nahavandi et al.

(10) Patent No.: US 11,633,313 B2
(45) Date of Patent: Apr. 25, 2023

(54) PATIENT SUPPORT APPARATUS WITH TOUCHSCREEN

(71) Applicant: Stryker Corporation, Kalamazoo, MI (US)

(72) Inventors: Kurosh Nahavandi, Portage, MI (US); Ian Christopher Geiman, South Lyon, MI (US)

(73) Assignee: Stryker Corporation, Kalamazoo, MI (US)

( * ) Notice: Subject to any disclaimer, the term of this patent is extended or adjusted under 35 U.S.C. 154(b) by 295 days.

(21) Appl. No.: 16/992,731

(22) Filed: Aug. 13, 2020

(65) Prior Publication Data

US 2021/0045948 A1 Feb. 18, 2021

Related U.S. Application Data

(60) Provisional application No. 62/885,953, filed on Aug. 13, 2019.

(51) Int. Cl.
*A61G 7/018* (2006.01)
*A61G 7/07* (2006.01)

(52) U.S. Cl.
CPC ..... *A61G 7/018* (2013.01); *A61G 7/07* (2013.01); *A61G 2203/16* (2013.01); *A61G 2203/20* (2013.01)

(58) Field of Classification Search
CPC ..... A61G 7/018; A61G 7/07; A61G 2203/16; A61G 2203/20
See application file for complete search history.

(56) References Cited

U.S. PATENT DOCUMENTS

D771,116 S 11/2016 Dellinger et al.
2003/0052787 A1* 3/2003 Zerhusen ..... A61G 12/004 340/286.07
2006/0101581 A1* 5/2006 Blanchard ..... A61G 7/05784 5/713
2018/0104123 A1 4/2018 Newkirk et al.
2018/0303687 A1 10/2018 Moreno et al.
2019/0336367 A1 11/2019 Zerhusen et al.

OTHER PUBLICATIONS

Stryker Patient Care Maintenance Manual Modular Patient System (MPS) 3000 Bed, Mar. 1994.
Stryker Operations Manual, S3 MedSurg Bed with StayPut Frame, Model 3005, Mar. 2012.

(Continued)

*Primary Examiner* — Fredrick C Conley
(74) *Attorney, Agent, or Firm* — Warner Norcross + Judd LLP

(57) ABSTRACT

A patient support apparatus, such as a bed, cot, stretcher, operating table, recliner, or the like, includes a litter frame, a support deck supported on the litter frame and adapted to support a mattress thereon, a touchscreen and a controller configured for carrying out various functions and to display various screens on the touchscreen, including screens for controlling a mattress therapy function or for controlling a non-mattress function of the patient support apparatus. A notification regarding the status of a mattress therapy function can be displayed on various screens. Status indications can be provided as a banner across a portion of the touchscreen.

20 Claims, 16 Drawing Sheets

(56) References Cited

OTHER PUBLICATIONS

Stryker Medical Secure 3000 Bed Operations Manual.
CHG Hospital Beds "User Manual for Spirit Select Beds".
Stryker Operations Manual Epic II Critical Care Bed, Model 2030, Jan. 2010.
Stryker Operations/Maintenance Manual XPRT Therapy Mattress Model 2950, Jun. 2006.
Stryker Operations Manual InTouch Critical Care Bed Model FL27, Apr. 2012.

* cited by examiner

PATIENT SUPPORT APPARATUS WITH TOUCHSCREEN

CROSS-REFERENCE TO RELATED APPLICATIONS

This application claims the benefit of U.S. provisional patent application Ser. No. 62/885,953 filed Aug. 13, 2019, by inventors Kurosh Nahavandi et al. and entitled PATIENT SUPPORT APPARATUS WITH TOUCHSCREEN, the complete disclosure of which is incorporated herein by reference.

BACKGROUND

The present disclosure relates to patient support apparatuses, such as beds, cots, stretchers, operating tables, recliners, or the like. More specifically, the present disclosure relates to patient support apparatuses that include user interfaces for controlling one or more components or systems of the patient support apparatus.

Conventional patient support apparatuses comprise a base, a litter frame, a support deck on the litter frame upon which the patient is supported, a lift system for lifting and lowering the support deck relative to the base, and an articulation system for articulating one or more sections of the support deck. Control of these and other systems of the patient support apparatus is performed via a user interface provided on a footboard or on one or more of the side rails of the patient support apparatus. Often, operation of the user interface is complex, making the user interface difficult to operate.

SUMMARY

According to various embodiments, an improved patient support apparatus is provided that includes a touchscreen user interface. In its various embodiments, the present disclosure provides a patient support apparatus having a user interface that is easy to navigate via a touchscreen. In some embodiments, the status of a mattress therapy function is provided on a patient support apparatus screen for controlling a non-mattress function of the patient support apparatus or on a mattress screen for controlling a different mattress therapy function. The need to navigate manually between different screens in order to ascertain the status of a mattress therapy function is reduced, thereby reducing the effort needed to ascertain the status and the chances of becoming lost and/or sidetracked when navigating through the various screens of the user interface. In other embodiments, status information and/or controls for a mattress therapy function is provided in a banner displayed on the touchscreen. The use of a banner to organize and display status information and/or controls for a mattress therapy function can prevent the user from accidentally navigating away from the screen when attempting to control the mattress therapy, and likewise can prevent changes to the therapy in progress when viewing or navigating to another screen, and can optionally provide a shortcut to ascertain the status or control a mattress therapy function without having to navigate to a screen dedicated to the mattress therapy function. These and/or other features are disclosed in the various embodiments discussed herein.

According to one embodiment of the present disclosure, a patient support apparatus is provided that includes a litter frame, a support deck adapted to support a mattress thereon, an actuator adapted to move a component of the patient support apparatus, such as the litter frame or the support deck, a touchscreen, and a controller. The controller is configured to display a mattress screen for controlling a mattress therapy function, the mattress screen including a start icon for initiating the mattress therapy function. The controller is also configured to display a patient support apparatus screen for controlling a non-mattress function of the patient support apparatus, the patient support apparatus screen including a control icon for operating the actuator to move the component and a therapy icon indicating a status of the mattress therapy function.

According to some embodiments, after user-selection of the therapy icon on the patient support apparatus screen, the controller is operable to display the mattress screen. The mattress screen can further include a pause icon for pausing the mattress therapy function and/or a stop icon for stopping the mattress therapy function.

Optionally, the patient support apparatus screen includes no controls for changing a setting of the mattress therapy function.

In at least one embodiment, the status of the mattress therapy function indicates whether the mattress therapy function is in progress or paused.

The controller is further configured, in at least some embodiments, to display additional patient support apparatus screens for controlling additional non-mattress functions of the patient support apparatus, and wherein the additional patient support apparatus screens include the therapy icon indicating the status of the mattress therapy function.

In at least one embodiment, the therapy icon is a first therapy icon indicating a status of a first mattress therapy function, and the patient support apparatus screen includes a second therapy icon indicating a status of a second mattress therapy function. The mattress screen can be a first mattress screen for controlling the first mattress therapy function, and the controller can be further configured to display a second mattress screen for controlling the second mattress therapy function, wherein the first therapy icon is displayed on the second mattress screen and the second therapy icon is displayed on the first mattress screen. In some embodiments, the first mattress therapy function is a lateral rotation function and the second mattress therapy function is a turn assist function. In embodiments where the mattress screen is a lateral rotation control screen, the controller can be further configured to display a turn assist control screen for controlling the second mattress therapy function, wherein both the lateral rotation control screen and the turn assist control screen include the first and second therapy icons. The controller can be configured to display the first therapy icon in a first color and the second therapy icon in a second color on the lateral rotation control screen, and optionally further configured to display the first therapy icon in the second color and the second therapy icon in the first color on the turn assist control screen.

Examples of the mattress therapy function include turning a patient or lateral rotation of a patient, and can further comprises inflating at least one bladder of the mattress, or a plurality of bladders of the mattress to different air pressures.

In embodiments where the mattress therapy function is the lateral rotation of a patient, the mattress screen can include a hold control for selecting how long the patient is held in a particular orientation. The mattress screen can further include a rotation direction control for selecting a direction in which the patient is rotated.

In embodiments where the mattress therapy function is a patient turn assist function, the mattress screen may include a hold control for selecting how long the patient is held in a turn. The mattress screen can further include a turn direction control for selecting a direction in which the patient is turned.

In at least one embodiment, the mattress screen further comprises a banner comprising a status bar indicating the status of the mattress therapy function and a stop icon for stopping the mattress therapy function. The banner can further comprise a lock icon for locking and unlocking a setting of the mattress therapy function, and/or a pause icon for pausing the mattress therapy function. The lock icon may indicate whether the setting is currently locked or unlocked. The pause icon may toggle between a pause icon that is displayed when the therapy is running and a start icon that is displayed when the therapy has been paused.

According to another embodiment of the present disclosure, a patient support apparatus is provided that includes a litter frame, a support deck adapted to support a mattress thereon, a touchscreen, and a controller. The controller is configured to display, on the touchscreen, a first mattress screen for controlling a first mattress therapy function, the first mattress screen including a first start icon for initiating the first mattress therapy function. The controller is also configured to display, on the touchscreen, a second mattress screen for controlling a second mattress therapy function, the second mattress screen including a second start icon for initiating the second mattress therapy function. After user-selection of the first start icon to initiate the first mattress therapy function, the controller displays a status bar indicating a status of the first mattress therapy function on the second mattress screen.

According to some embodiments, the status bar comprises a name of first mattress therapy function, a time remaining for the first mattress therapy function, and/or other status information.

In some embodiments, the status bar is provided in a banner across a bottom of the screen. The banner can further comprise a stop icon for stopping the first mattress therapy function and a lock icon for locking and unlocking a setting of the first mattress therapy function, the lock icon further indicating whether the setting is currently locked or unlocked.

In at least one embodiment, the second mattress screen includes a control icon for controlling the first mattress therapy function. The second mattress screen can further comprise a pause icon for pausing the first mattress therapy function and/or a stop icon for stopping the first mattress therapy function. In some embodiments, after user-selection of the stop icon or the pause icon, the controller is operable to remove the status bar from the second mattress screen, to remove a time from the status bar, to change a color of the status bar, to change a text of the status bar, and/or to replace the status bar indicating the status of the first mattress therapy function with another status bar indicating a status of the second mattress therapy function on the second mattress screen. The controller can further be operable to disable the second start icon on the second mattress screen until the first mattress therapy function is paused or stopped.

In some embodiments, the status of the first mattress therapy function indicates whether the first mattress therapy function is in progress or paused. The controller is further configured, in at least some embodiments, to disable the second start icon on the second mattress screen while the first mattress therapy function is in progress.

In at least one embodiment, the controller is operable to display a therapy icon for switching to the first mattress screen on the second mattress screen, wherein, after user-selection of the therapy icon on the second mattress screen, the controller is operable to display the first mattress screen. The therapy icon for switching to first mattress screen can include an indication of a status of the first mattress therapy function. The controller is further configured, in at least some embodiments, to display the therapy icon in a first color on the second mattress screen and in a second color on the first mattress screen.

In some embodiments, the first mattress therapy function is lateral rotation function and the second mattress therapy function is turn assist function. In embodiments where the mattress therapy function is lateral rotation of a patient, the mattress screen can include a hold control for selecting how long the patient is held in a particular orientation. The mattress screen can further include a rotation direction control for selecting a direction in which the patient is rotated. In embodiments where the mattress therapy function is for assisting in the turning of a patient, the mattress screen may include a hold control for selecting how long the patient is held in a turn. The mattress screen can further include a turn direction control for selecting a direction in which the patient is turned.

The controller is further configured, in at least some embodiments, to display a patient support apparatus screen for controlling a non-mattress function of the patient support apparatus, the patient support apparatus screen including a first therapy icon indicating a status of the first mattress therapy function. The patient support apparatus screen can further include a second therapy icon indicating a status of the second mattress therapy function, and/or a control icon for operating an actuator adapted to move the litter frame, the support deck, or a section of the support deck.

According to yet another embodiment of the present disclosure, a patient support apparatus is provided that includes a litter frame, a support deck adapted to support a mattress thereon, a touchscreen, and a controller configured to display a mattress screen on the touchscreen for controlling a mattress therapy function. The mattress screen includes a start icon for initiating the mattress therapy function and a banner. The banner comprises a status bar indicating the status of the mattress therapy function, a stop icon for stopping the mattress therapy function, and a lock icon for locking and unlocking a setting of the mattress therapy function The lock icon indicates whether the setting is currently locked or unlocked.

According to some embodiments, the status bar comprises an indication of a time remaining for the mattress therapy function, a name of the mattress therapy function, and/or an indication of whether the mattress therapy function is running or paused. In some embodiments, the lock icon is displayed at a first end of the status bar and the stop icon is displayed at a second end of the status bar.

In some embodiments, the banner further includes a pause icon for pausing the mattress therapy function. After user-selection of the stop icon to stop the mattress therapy function or the pause icon to pause the mattress therapy function, the controller is operable to change a color of the status bar, to remove a time from the status bar, to change a text of the status bar, and/or remove the status bar from the banner.

The controller is further configured, in at least some embodiments, to display the banner across a bottom of the mattress screen. The status bar, stop icon, and lock icon can be juxtaposed within the banner.

In at least one embodiment, the mattress screen further comprises a control icon for changing the setting of the mattress therapy function. After user-selection of the control icon, the controller can be configured to determine if the setting of the mattress therapy function is locked or unlocked, and if the controller determines the setting is locked, the controller is operable to display an overlay on the mattress screen. In some embodiments, the overlay comprises the lock icon.

Examples of the mattress therapy function include turning a patient or lateral rotation of a patient, and can further comprises inflating at least one bladder of the mattress, or a plurality of bladders of the mattress to different air pressures.

In embodiments where the mattress therapy function is lateral rotation of a patient, the mattress screen can include a hold control for selecting how long the patient is held in a particular orientation. The mattress screen can further include a rotation direction control for selecting a direction in which the patient is rotated.

In embodiments where the mattress therapy function is for assisting in the turning of a patient, the mattress screen includes a hold control for selecting how long the patient is held in a turn. The mattress screen can further include a turn direction control for selecting a direction in which the patient is turned.

The controller is further configured, in at least some embodiments, to display a patient support apparatus screen for controlling a non-mattress function of the patient support apparatus, the patient support apparatus screen including a therapy icon indicating a status of the mattress therapy function. In one example, the patient support apparatus screen comprises a control icon for operating an actuator adapted to move the litter frame, the support deck, or a deck section of the support deck.

In at least one embodiment, the mattress screen is a first mattress screen for controlling a first mattress therapy function, the controller is further configured to display a second mattress screen for controlling a second mattress therapy function, and the first mattress screen comprises a therapy icon for switching to the second mattress screen. After user-selection of the therapy icon on the first mattress screen, the controller can be operable to display the second mattress screen and the banner from the first mattress screen on the second mattress screen. The therapy icon can include an indication of a status of the second mattress therapy function.

In still other embodiments, the touch screen is replaced by a non-touch display and one or more separate controls are utilized in conjunction with the content of the screens displayed on the non-touch display to achieve one or more of the same or similar functions that are described herein with respect to a touchscreen.

Before the various embodiments disclosed herein are explained in detail, it is to be understood that the claims are not to be limited to the details of operation, to the details of construction, or to the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
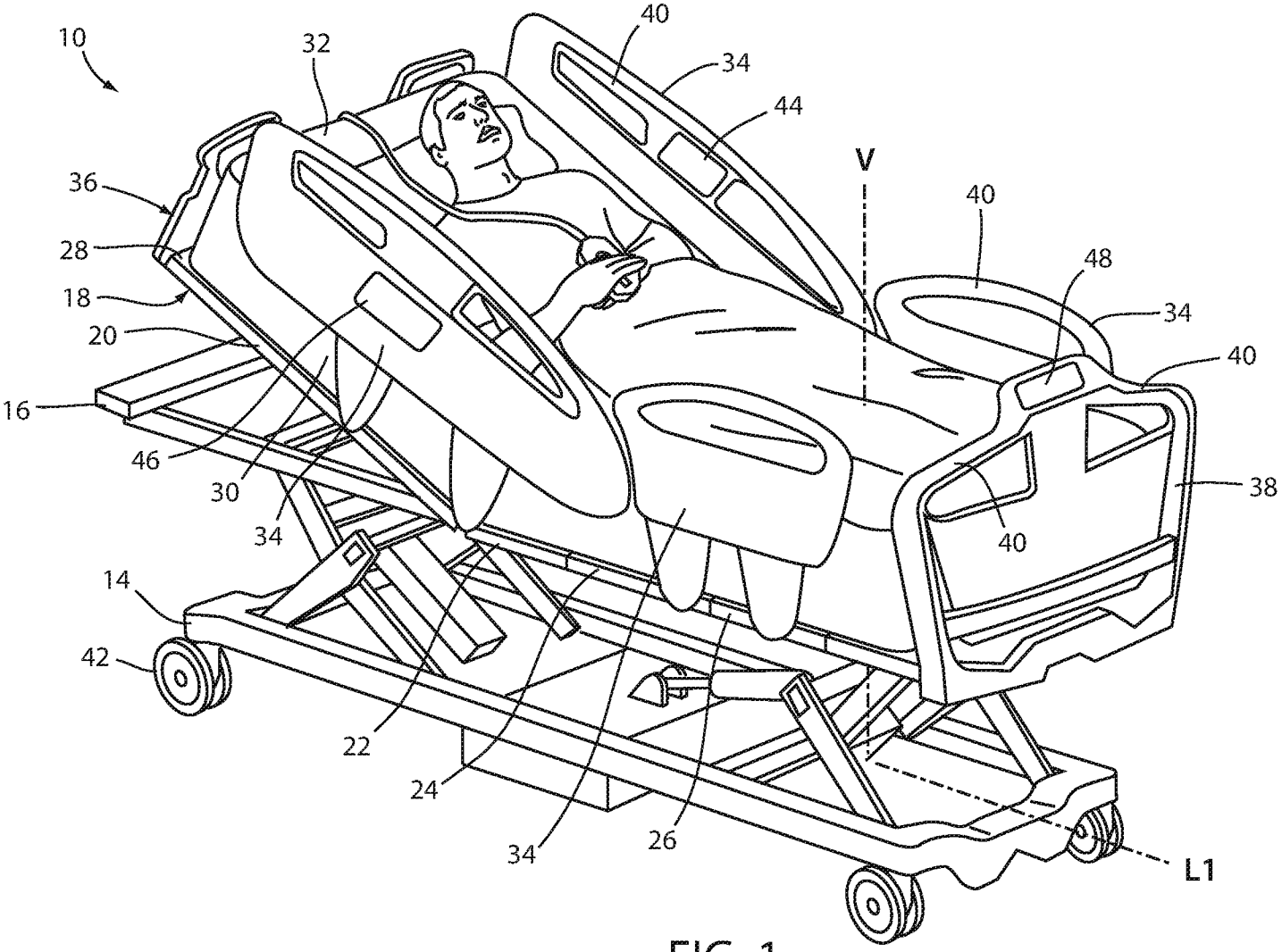
FIG. 1 is a perspective view of a patient support apparatus according to one embodiment of the disclosure.

An illustrative patient support apparatus 10 incorporating one or more aspects of the present disclosure is shown in FIG. 1. Although the particular form of patient support apparatus 10 illustrated in FIG. 1 is a bed adapted for use in a hospital or other medical setting, it will be understood that patient support apparatus 10 could, in different embodiments, be a cot, a stretcher, a gurney, a recliner, or any other structure capable of supporting a patient that may be used during times when the patient is not accompanied by a caregiver. For purposes of the following written description, patient support apparatus 10 will be described as a bed with the understanding the following written description applies to these other types of patient support apparatuses.

In general, patient support apparatus 10 provides support for the patient and comprises a base 14 and a litter frame 16. The patient support apparatus 10 also comprises a support deck 18 supported on the litter frame 16. Support deck 18 is made of a plurality of sections, some of which are pivotable about generally horizontal pivot axes relative to the litter frame 16. In the embodiment shown in FIG. 1, support deck 18 includes a head section 20, a seat section 22, a thigh section 24, and a foot section 26. Head section 20, which is also sometimes referred to as a Fowler section, is pivotable about a generally horizontal pivot axis between a generally horizontal orientation (not shown in FIG. 1) and a plurality of raised positions (one of which is shown in FIG. 1). Thigh section 24 and foot section 26 may also be pivotable about generally horizontal pivot axes. The support deck 18 provides a mattress support surface 28 upon which a mattress 30 is supported.

The deck sections 20, 22, 24, 26 are pivotally coupled together by pivot pins, shafts, and the like at pivot joints (not shown) between adjacent deck sections. Additionally, other types of connections are possible between the deck sections 20, 22, 24, 26 so that the deck sections are capable of moving, e.g., articulating, relative to one another. For instance, in some cases, translational joints may be provided between adjacent deck sections, or other compound movement connections may be provided between adjacent deck sections, such as joints that allow both pivotal and translational motion between adjacent deck sections. Further, in other cases, the head section 20 and the thigh section 24 may be pivotally (or otherwise) connected directly to the litter frame 16 instead of the seat section 22.

The mattress 30 provides a patient support surface 32 upon which the patient is supported. The base 14, litter frame 16, support deck 18, and patient support surface 32 each have a head end and a foot end corresponding to a designated placement of the patient's head and feet on the patient support apparatus 10. The base 14 defines a longitudinal axis L1 along its length from the head end to the foot end. The base 14 also defines a vertical axis V arranged crosswise (e.g., perpendicularly) to the longitudinal axis L1 along which the litter frame 16 is lifted and lowered relative to the base 14.

Patient barriers, such as side rails 34 are coupled to the litter frame 16 and/or support deck 18 and are thereby supported by the base 14. Side rails 34 are all shown in a raised position in FIG. 1 but are each individually movable to a lower position in which ingress into, and egress out of, patient support apparatus 10 is not obstructed by the lowered side rails 34. In some embodiments, side rails 34 may be moved to one or more intermediate positions as well.

A headboard assembly 36 and a footboard 38 are coupled to the litter frame 16. Both the headboard assembly 36 and the footboard 38 are removably mounted on the litter frame 16. The headboard assembly 36 is coupled to the head section 20 in certain embodiments, but in other embodiments may be coupled to the litter frame 16.

Handles 40 are provided on the side rails 34 and footboard 38 to facilitate movement of the patient support apparatus 10 over a floor surface, to move the side rails 34, and the like. Additional handles may be provided on other components of the patient support apparatus 10.

Wheels 42 are coupled to the base 14 to facilitate transport over a floor surface. The wheels 42 are arranged in each of four quadrants of the base 14 adjacent to corners of the base 14. In the embodiment shown, the wheels 42 are caster wheels able to rotate and swivel relative to the base 14 during transport. In some cases, the patient support apparatus 10 may not include any wheels. In still other embodiments, one or more of the caster wheels 42 may be selectively lockable so that they do not swivel. Further, a brake may be included to prevent one or more of wheels 42 from rotating, when desired.

Patient support apparatus 10 further includes a plurality of user interfaces 44, 46, 48 that enable a user of patient support apparatus 10, such as a patient and/or an associated caregiver, to control one or more aspects of patient support apparatus 10. In the embodiment shown in FIG. 1, patient support apparatus 10 includes a pair of inner side rail user interfaces 44 (only one of which is visible), a pair of outer side rail user interfaces 46 (only one of which is visible), and a footboard user interface 48. Footboard user interface 48 and outer side rail user interfaces 46 are intended to be used by caregivers, or other authorized personnel, while inner side rail user interfaces 44 are intended to be used by the patient associated with patient support apparatus 10. Not all of the user interfaces 44, 46, 48 include the same controls and/or functionality. In the illustrated embodiment, footboard user interface 48 includes a substantially complete set of controls for controlling patient support apparatus 10, including mattress 30, while user interfaces 44 and 46 include a selected subset of those controls.

The mechanical construction of those aspects of patient support apparatus 10 not explicitly described herein may be the same as, or nearly the same as, the mechanical construction of the Model 3002 S3 bed manufactured and sold by Stryker Corporation of Kalamazoo, Mich. This mechanical construction is described in greater detail in the Stryker Maintenance Manual for the MedSurg Bed, Model 3002 S3, published in 2010 by Stryker Corporation of Kalamazoo, Mich., the complete disclosure of which is incorporated herein by reference. It will be understood by those skilled in the art that those aspects of patient support apparatus 10 not explicitly described herein can alternatively be designed with other types of mechanical constructions, such as, but not limited to, those described in commonly assigned, U.S. Pat. No. 7,690,059 issued to Lemire et al., and entitled HOSPITAL BED; and/or commonly assigned U.S. Pat. publication No. 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosures of both of which are also hereby incorporated herein by reference. The mechanical construction of those aspects of patient support apparatus 10 not explicitly described herein may also take on forms different from what is disclosed in the aforementioned references.

Figure 2:
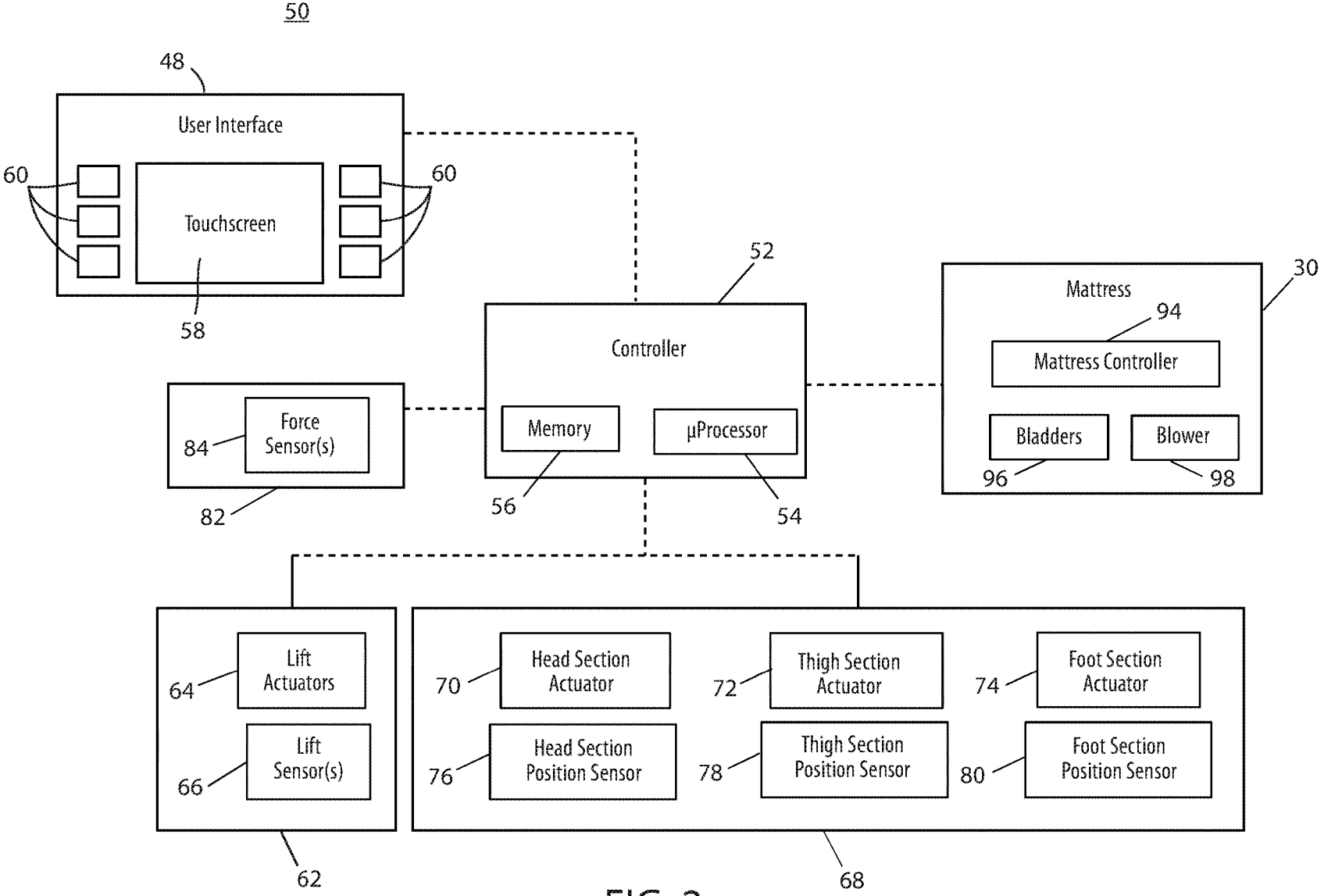
FIG. 2 is a diagram of a control system of the patient support apparatus of FIG. 1.

Referring additionally to FIG. 2, the patient support apparatus 10 includes a control system 50 provided to control operation of various components of the patient support apparatus 10. The control system 50 includes a controller 52 having one or more microprocessors 54 for processing instructions or for processing an algorithm stored in a memory 56 accessible to microprocessor 54 to control operation of the various components.

Controller 52 is constructed of any electrical component, or group of electrical components, that are capable of carrying out the functions described herein. In many embodiments, controller 52 is a conventional microcontroller, although not all such embodiments need include a microcontroller. In general, controller 52 includes any one or more of microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by controller 52 in carrying out the functions described herein, as well as the data necessary for carrying out these functions, are stored in memory 56.

Controller 52 is in communication with footboard user interface 48, as shown in FIG. 2. Controller 52 also communicates with the user interfaces 44 and 46 that are positioned on patient support apparatus 10, although these are not shown in FIG. 2 for purposes of clarity. Footboard user interface 48 includes a display 58 and a plurality of controls 60. Display 58 is a touchscreen in at least some embodiments, although it will be understood that a non-touchscreen display may alternatively be used. The touchscreen 58 can be a multi-touch screen display capable of recognizing more than one point of contact. Controls 60 are shown in FIG. 2 as touch sensitive controls that may be physically implemented in a variety of different manners. In some embodiments, controls 60 are implemented as capacitive sensors positioned adjacent touchscreen 58 that capacitively detect when a user presses them. In other embodiments, controls 60 are implemented as buttons, switches, or other types of force or touch-sensitive device. In still other embodiments, one or more of the functions controlled by controls 60 may be incorporated into corresponding icons and/or visual controls displayed on touchscreen 58. Still other variations are possible.

The patient support apparatus 10 further comprises a lift system 62 that operates to lift and lower the litter frame 16, and thereby the support deck 18, relative to the base 14. The particular structural details of lift system 62 can vary widely. In the embodiment shown in FIG. 2, lift system 62 includes lift actuators 64 configured to move the litter frame 16 to any desired position, including tilting the litter frame 16 with respect to the base 14, and one or more lift sensor(s) 66 configured to the height and/or the angle of the litter frame 16. The lift actuators 64 can be operated independently, i.e. so that the head end and foot end of litter frame 16 can be independently adjusted, to place the litter frame 16 in a flat position, a Trendelenburg position, or a reverse Trendelenburg position. Patient support apparatus 10 is designed so that when an occupant lies thereon, his or her head will be positioned adjacent the head end and his or her feet will be positioned adjacent the foot end. The lift actuators 64 may include hydraulic actuators, electric actuators, or any other suitable device for raising and lowering litter frame 16 with respect to base 14. Lift sensor(s) 66 may include any suitable sensor for detecting the height and/or angle of the litter frame 16 with respect to base 14. One exemplary lift system 62 is described in U.S. Patent Application Pub. No. 2017/0246065, filed on Feb. 22, 2017, entitled "Lift Assembly for Patient Support Apparatus," which is hereby incorporated by reference herein in its entirety. Other types of lift systems can also be used, such as those described in U.S. Patent Application Publication No. 2016/0302985, filed on Apr. 20, 2016, entitled "Patient Support Lift Assembly," which is hereby incorporated by reference herein in its entirety. Controller 52 processes instructions or an algorithm stored in memory to control operation of the lift actuator(s) 64 and coordinate movement of the lift actuator(s) 64 to move the litter frame 16, including lifting, lowering, or tilting the litter frame 16.

The patient support apparatus 10 further comprises an articulation system 68 that articulates the deck sections 20, 24, and 26 of the support deck 18. The particular structural details of articulation system 68 can vary widely. In the embodiment shown in FIG. 2, articulation system 68 includes at least one head section actuator 70, at least one thigh section actuator 72, and at least one foot section actuator 74 capable of moving, i.e. pivoting or articulating, the head section 20, thigh section 24, and foot section 26, respectively, relative to one other and relative to the seat section 22, which is stationary or fixed in the current embodiment. The deck section actuators 70, 72, 74 may be linear actuators, rotary actuators, or other type of actuators capable of moving the head section 20, thigh section 24, and foot section 26. The deck section actuators 70, 72, 74 may be electrically powered, hydraulic, electro-hydraulic, pneumatic, or the like. The articulation system 68 further includes one or more position sensor(s) 76, 78, 80 configured to detect a configuration of the support deck 18, including the position or angle of each of the head section 20, thigh section 24, and foot section 26. Position sensor(s) 76, 78, 80 may include tilt sensors or potentiometers for sensing an angular position of the associated deck section 20, 24, 26, or any other suitable sensor for detecting the position or angle of the deck sections 20, 24, 26. One exemplary articulation system 68 is described in U.S. Pat. No. 7,472,439, filed on Feb. 23, 2006, entitled "Hospital Patient Support," which is hereby incorporated by reference herein in its entirety. Controller 52 processes instructions or an algorithm stored in memory to control operation of the deck section actuators 70, 72, 74 and coordinate movement of the deck section actuators 70, 72, 74 to move one or more of the deck sections.

The patient support apparatus 10 further comprises a scale/exit detection system 82 that is used to detect the weight of an occupant of the apparatus 10 and/or that is used as an exit detection system. The particular structural details of scale/exit detection system 82 can vary widely. In the embodiment shown in FIG. 2, scale/exit detection system 82 includes one or more force sensor(s) 84 such as, but not limited to, load cells, linear variable displacement transducers and/or any one or more capacitive, inductive, and/or resistive transducers that are configured to produce a changing output in response to changes in the force exerted against them. Still other types of forces sensors may be used with patient support apparatus 10. When functioning as a scale system, the outputs of the force sensor(s) 84 are read and a weight of the occupant is detected. When functioning as an exit detection system, the outputs of the force sensor(s) 84 are read and used to detect when an occupant has exited the apparatus 10, or when an occupant may be about to exit the apparatus 10. One exemplary scale/exit detection system 82 is described in U.S. Patent Application Pub. No. 2017/0003159, filed on Jun. 17, 2016, entitled "Person Support Apparatus with Load Cells," which is hereby incorporated by reference herein in its entirety. Another exemplary exit detection system is described in U.S. Pat. No. 5,276,432, filed on Jan. 15, 1992, entitled "Patient Exit Detection Mechanism for Hospital Bed," which is hereby incorporated by reference herein in its entirety. Other types of scale and/or exit detection systems may be used.

The mattress 30 includes a mattress controller 94 used in controlling one or more therapy functions of the mattress. Mattress therapy functions include at a least lateral rotation therapy function and a turn assist function. Additional and/or alternative mattress therapy functions may also be included, such as, but not limited to, one or more of the following: an alternating pressure therapy, a percussion therapy, a vibration therapy, and a pressure redistribution therapy. The particular structural details of mattress 30 can vary widely. In the embodiment shown in FIG. 2, mattress 30 includes a pneumatic system having one or more bladders 96 and at least one blower 98 for inflating and deflating one or more of the bladders 96. One exemplary mattress 30 that may be used with the patient support apparatus 10 is described in U.S. Patent Application Pub. No. 2014/0059780, filed on Sep. 5, 2013, entitled "Patient Support," which is hereby incorporated by reference herein in its entirety. In lateral rotation therapy, sometimes referred to as continuous lateral rotation therapy or simply rotation therapy, a patient supported on the mattress 30 is rotated side to side in an effort to reduce pulmonary complications of immobility. For turn assist, a patient supported on the mattress 30 is turned or rotated laterally to one side for a period of time to help reposition the patient, such as to prevent bed sores.

Figure 3:
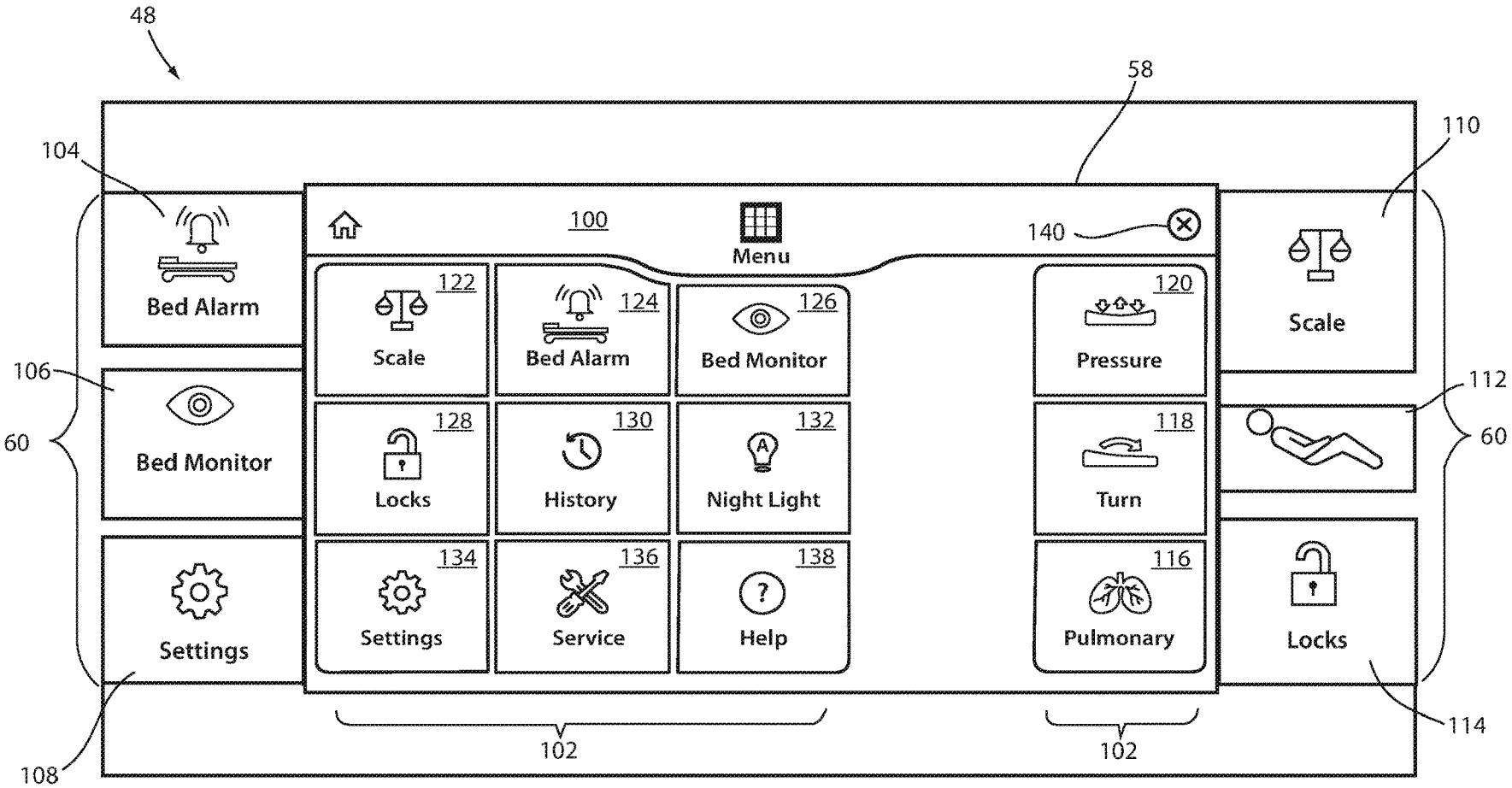
FIG. 3 is a diagram of a user interface of the patient support apparatuses of FIGS. 1 and 2, the user interface having a touchscreen.

FIG. 3 illustrates in more detail one manner in which user interface 48 (or another user interface 44 or 46 on patient support apparatus 10) is implemented. User interface 48 includes a menu screen 100 displayed on the touchscreen 58 having a plurality of touchscreen controls 102, and a plurality of non-touchscreen controls 60 that are positioned adjacent to touchscreen 58.

In the particular example of FIG. 3, the non-touchscreen controls 60 include a bed alarm control 104, a bed monitor control 106, a settings control 108, a scale control 110, a position control 112, and a locks control 114, although it will be understood that in different embodiments, any of these controls could be implemented as a touchscreen control 102. Each of these controls, when activated, causes controller 52 to displaying a corresponding control screen on touchscreen display 58. For example, when bed alarm control 104 is activated, controller 52 displays an exit detection system control screen (not shown) that enables the user to arm and/disarm the exit detection system, as well as to change one or more of the settings associated with the exit detection system.

Activating the bed monitor control 106 brings up a bed monitor control screen (not shown) on touchscreen 58 that includes controls for controlling a bed monitoring system of the patient support apparatus 10, including controls for activating and deactivating the bed monitoring system and changing one or more settings of the bed monitoring system. One exemplary bed monitoring system that may be incorporated into the patient support apparatus 10 is described in U.S. Pat. No. 8,844,076, filed on Jan. 27, 2014, entitled "Patient Handling Device Including Local Status Indication, One-Touch Fowler Angle Adjustment, and Power-On Alarm Configuration," which is hereby incorporated by reference herein in its entirety.

Settings control 108, when activated, causes a settings screen to be displayed that enables a user to change one or more settings of the patient support apparatus 10. The scale control 110, when pressed, causes a scale screen (e.g. scale screen 260 of FIG. 12) to be displayed. The scale screen is used by a caregiver to take a weight reading of an occupant of the patient support apparatus 10 using the scale/exit detection system 82, as well as to control other aspects of the scale system.

Figure 11:
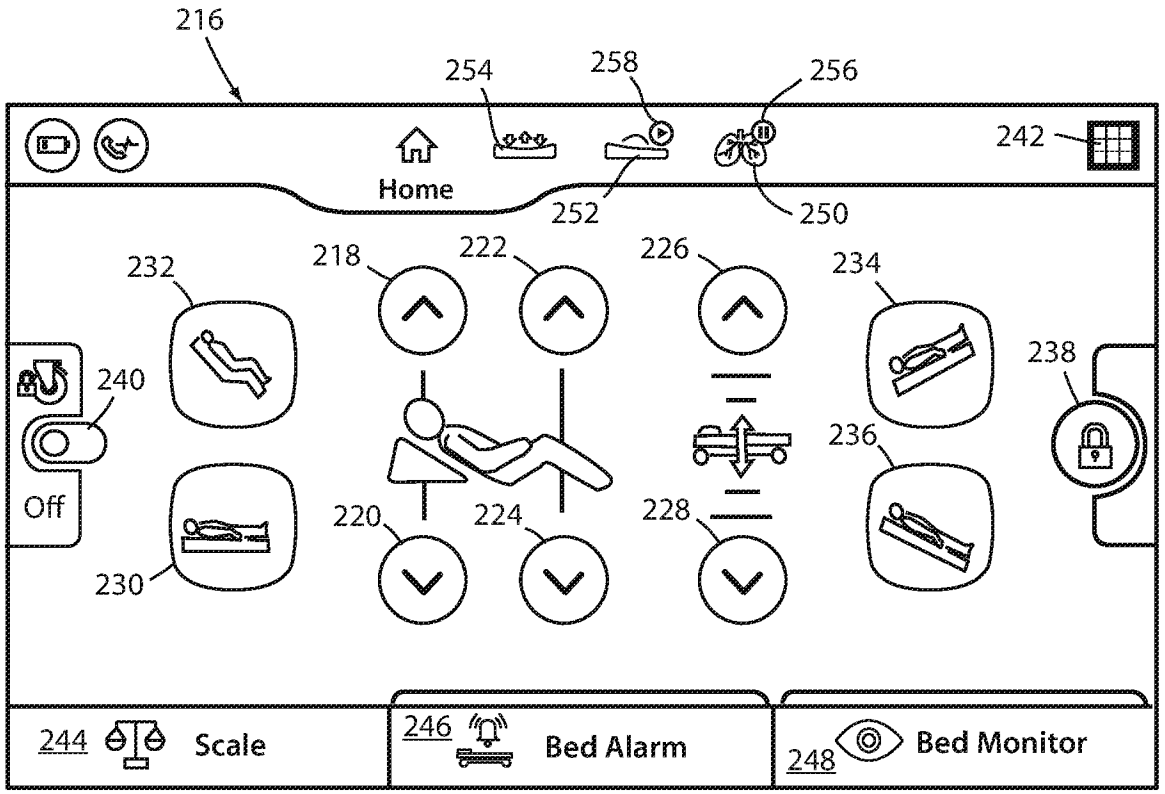
FIG. 11 is an illustrative position control screen that may be displayed on the touchscreen.

Position control 112, when activated by a user, causes controller 52 to display a position control screen, such as position control screen 216 of FIG. 11). Position control screen 216 includes a plurality of controls enabling the user to change a configuration or position of the patient support apparatus 10, such as changing the height or angle of the litter frame 16 using the lift system 62 or the configuration of the support deck 18 using the articulation system 68, as described in further detail below.

Locks control 114, when activated by a user, brings up a lock control screen (not shown) is used to prevent the configuration or position of the patient support apparatus 10 from being changed at one of the other user interfaces 44 or 46. That is, control of the lift system 62 and the articulation system 68 can be locked out from the other user interfaces 44 or 46.

The touchscreen controls 102 may perform a variety of different functions, and the number, function, lay-out, size, and/or other characteristics of these controls may vary from what is shown in FIG. 3, and may also vary depending upon what screen is being displayed at a given time by touchscreen 58.

Figure 12:
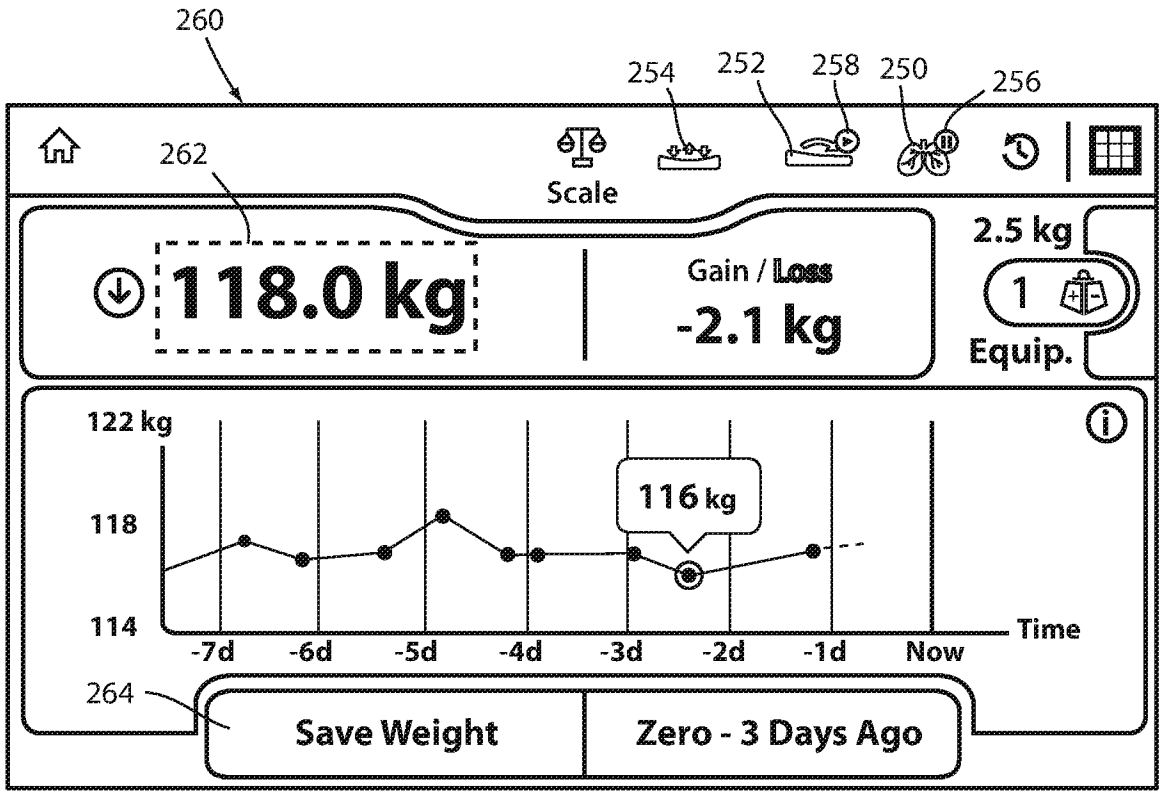
FIG. 12 is an illustrative scale screen that may be displayed on the touchscreen.

Some non-limiting examples of screens and touchscreen controls are provided in the FIGS. 3-16. FIG. 3 illustrates the menu screen 100 displayed on the touchscreen 58. Other screens that are displayable on touchscreen 58 are used to control a mattress therapy function of the mattress 30, examples of which are shown in FIGS. 4-10 and 13-16, including lateral rotation therapy and turn assist. Other screens are used to a control a non-mattress function of the patient support apparatus 10, examples of which are shown in FIG. 11-12. Some examples of non-mattress functions include, but are not limited to, position control, scale control, bed alarm control, bed monitor control, settings control, and locks control.

Referring to FIG. 3, menu screen 100 may be displayed initially after the patient support apparatus 10 is powered on, or it may be displayed in response to a user navigating to it from another screen. It will be understood that the particular layout shown in FIG. 3 is only one of a large variety of different ways in which controller 52 may present a menu screen.

As can be seen in FIG. 3, menu screen 100 includes a plurality of touchscreen controls, including at least a lateral rotation control 116 and a turn assist control 118. User selection of either of these controls 116, 118 displays a different screen, particular to the associated control, on the touchscreen 58, examples of which are given below. Additional touchscreen controls include a pressure control 120, a scale control 122, a bed alarm control 124, a bed monitor control 126, a locks control 128, a history control 130, a night light control 132, a settings control 134, a service control 136, and a help control 138. User selection of any one of these controls 120-138 displays a different screen, particular to the associated control, on the touchscreen 58. Examples of screens for controls 120 and 124-138 are not provided herein as they are not necessary for understanding the inventive concepts disclosed herein. Briefly, the bed alarm control 124, bed monitor control 126, locks control 128, and settings control 134 are touchscreen duplicates of the non-touchscreen controls 104, 106, 114, 108, respectively. The pressure control 120 displays a pressure redistribution therapy control screen (not shown) which includes control inputs for operating the mattress 30 in a pressure redistribution mode. The history control 130 displays a history screen (not shown) which includes historical information on the operation or maintenance of the patient support apparatus 10. The night light control 132 displays a night light screen (not shown) which includes control inputs for a night light of the patient support apparatus 10. The service control 136 displays a service screen (not shown) which includes information on service topics such as how to perform or request maintenance on the patient support apparatus 10. The help control 138 displays a help screen (not shown) which includes information on help topics such as the use, operation, and functions of the patient support apparatus 10. A cancel control 140 allows the user to return to a home screen or the previously displayed screen.

Figure 4:
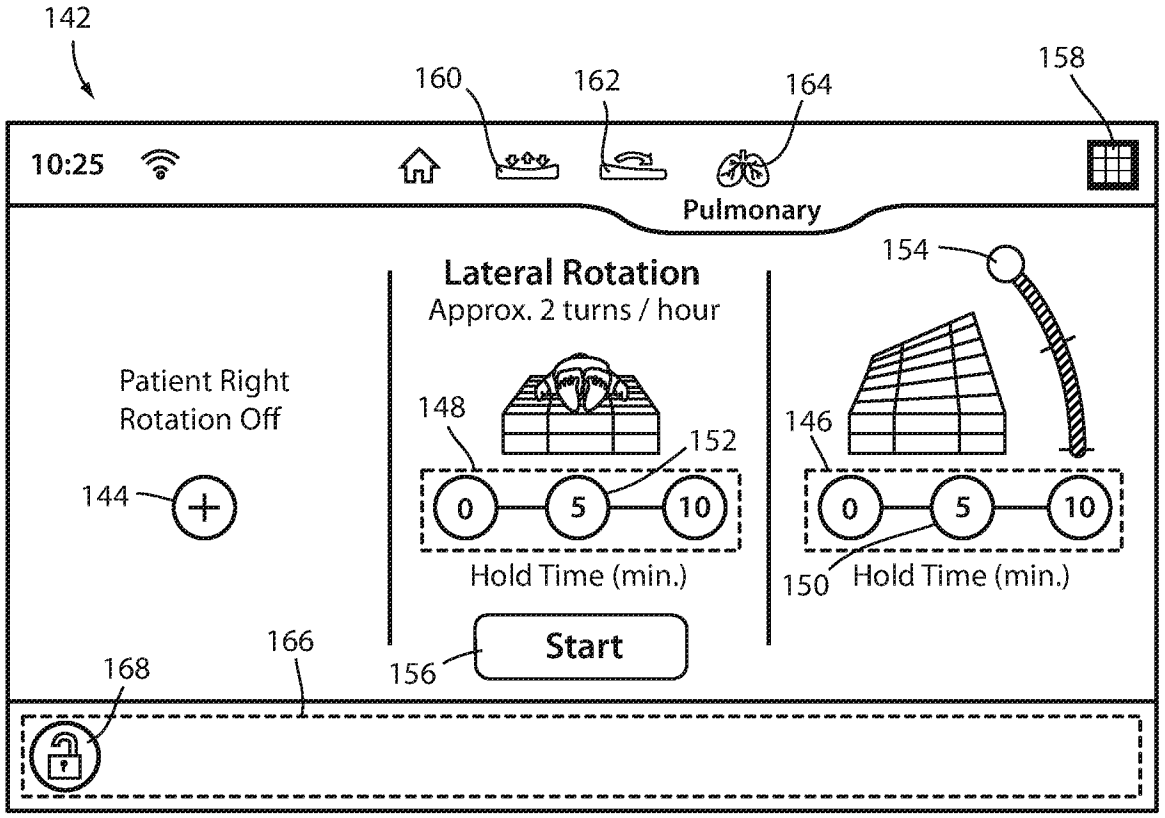
FIG. 4 is an illustrative lateral rotation therapy control screen that may be displayed on the touchscreen of FIG. 3.

When the lateral rotation control 116 on the user interface 48 of FIG. 3 is selected, controller 52 displays lateral rotation control screen 142, shown in FIG. 4, on touchscreen 58. Lateral rotation control screen 142 is one example of a mattress screen for controlling a mattress therapy function of the mattress 30, specifically for controlling the mattress 30 to rotate a patient supported on the mattress 30 side to side in an effort to reduce pulmonary complications of immobility.

The display of screen 142 may occur immediately after the lateral rotation control 116 is pressed, or there may be one or more intermediate controls/screens that need to be followed before getting to screen 142. However arrived at, the display of lateral rotation control screen 142 includes one or more controls for inputting a desired rotation program, including inputting patient orientation and the hold time per orientation. Specifically, the screen 142 includes direction controls 144, 146, 148 for selecting a right rotation in which the patient is rotated to the right, a left rotation in which the patient is rotated to the left, and a center or non-rotated orientation in which the patient is held flat between turns. As illustrated, the right rotation control 144 is not selected in FIG. 4. Upon selection of a direction or orientation, controller 52 is displays a further hold control 150, 152 for selecting the amount of time the patient is held in the particular orientation. As illustrated, the left rotation and center orientations are shown as being set to 5 minutes in FIG. 4. Upon selection of right or left rotation, controller 52 displays a further control 154 for selecting the degree of rotation. By touching and sliding control 154 along the length of the illustrated arc, the user is able to select the specific amount of rotation he or she would like the mattress 30 to implement during the lateral rotation therapy. As illustrated, a maximum degree of left rotation is selected in FIG. 4.

A start icon 156 is provided on screen 142 for initiating lateral rotation therapy once a desired rotation program is set. Based on the settings of the currently selected rotation program, controller 52 (FIG. 2) communicates with the mattress controller 94 to operate the at least one blower 98 to inflate and/or deflate one of more of the bladders 96 as needed to carry out the selected rotation program, including inflate and/or deflate one of more of the bladders 96 to different air pressures.

The screen 142 includes control icons for non-mattress functions as well, including a menu control 158 for returning to the menu screen 100 (FIG. 3). One or more shortcuts can be provided on the screen 142 to navigate to other mattress screens without having to return to the menu screen 100. In the illustrated embodiment, a pressure redistribution therapy icon 160 and a turn assist therapy icon 162 are provided for navigating to screens particular to the associated control, and can navigate to the same screens as controls 120 and 118, respectively, on the menu screen 100. An icon 164 representing lateral rotation therapy is displayed adjacent to the other mattress therapy icons 160, 162, and is particularly displayed in a different color, size, and/or with changed or new associated text to indicate to a user that the current screen 142 is for controlling lateral rotation therapy. Additional changes to the color, size, and/or text associated with icon 164 are made, in at least some embodiments, when lateral rotation therapy is started (and such changes are rescinded when the lateral rotation therapy stops.

The screen 142 further comprises a banner 166 which selectively indicates the status of the lateral rotation therapy function and optionally includes one or more controls for lateral rotation therapy. Prior to initiation of the lateral rotation therapy, the banner 166 can be absent from the screen 142, or can have fewer icons as shown in FIG. 4. The banner 166 in FIG. 4 includes a lock icon 168 for locking and unlocking at least one setting of the lateral rotation therapy function, such as all settings of the currently selected rotation program, including the currently inputted patient orientation and the hold time per orientation. As illustrated, the lock icon 168 is unlocked in FIG. 4.

Figure 5:
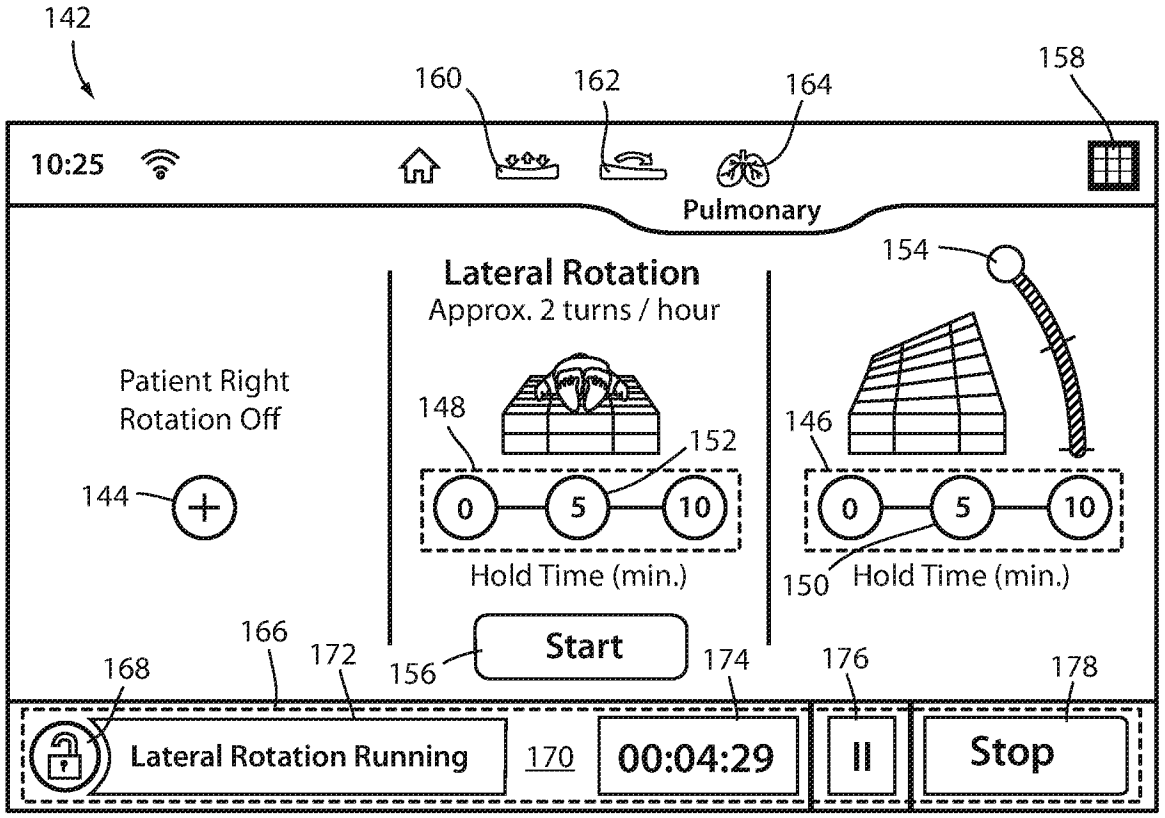
FIG. 5 is the lateral rotation therapy control screen of FIG. 4 modified to show that lateral rotation therapy is in progress.

Upon selection of the start icon 156, controller 52 displays additional information and/or controls on screen 142. As shown in FIG. 5, after lateral rotation therapy is initiated, the screen 142 includes a status bar 170 indicating the current status of the lateral rotation therapy. The status bar 170 comprises a graphical element visualizing the status of the mattress therapy function, and further comprises an indication 172 of a name of mattress therapy function being carried out, and an indication 174 of a time remaining for the mattress therapy function (or a time passed since initiation), which is dynamically updated by controller 52 as the therapy function progresses. The indication 174 of the time remaining (or time passed) can be a timed countdown (or count-up), a percent completed, or an animated progress bar, i.e. a graphical element visualizing the progression of the mattress therapy function. As shown in FIG. 5, the status bar 170 indicates that the lateral rotation therapy function is in progress or running, and includes a timed countdown.

When the lateral rotation therapy is in progress or running, the screen 142 includes a pause icon 176 for pausing lateral rotation therapy function and a stop icon 178 for stopping the lateral rotation therapy function. The status bar 170, pause icon 176, and stop icon 178 are displayed in the banner 166, along with the lock icon 168. The status bar 170, pause icon 176, stop icon 178, and lock icon 168 are juxtaposed within the banner 166, with the lock icon 168 on one end, the stop icon 178 on the opposite end, and the status bar 170 and pause icon 176 side by side in between the lock icon 168 and the stop icon 178.

The banner 166 is displayed at the bottom of the screen 142. Spacing the banner 166 from the control icons 158, 160, 162 unrelated to the lateral rotation therapy function can prevent the user from accidentally navigating away from the screen 142 when attempting to pause or stop the therapy, and likewise can prevent changes to the therapy in progress when attempting to navigate to another screen. Alternatively, the banner 166 can be displayed at the top of the screen 142 or along one side of the screen 142.

The color of the status bar 170 provides a visual indication of the current status of the lateral rotation therapy on the touchscreen 58. The status bar 170 is displayed in one color when the lateral rotation therapy function is in progress or running, as shown in FIG. 5, and is displayed in a different color when the lateral rotation therapy function is paused, as shown in FIG. 6.

Figure 6:
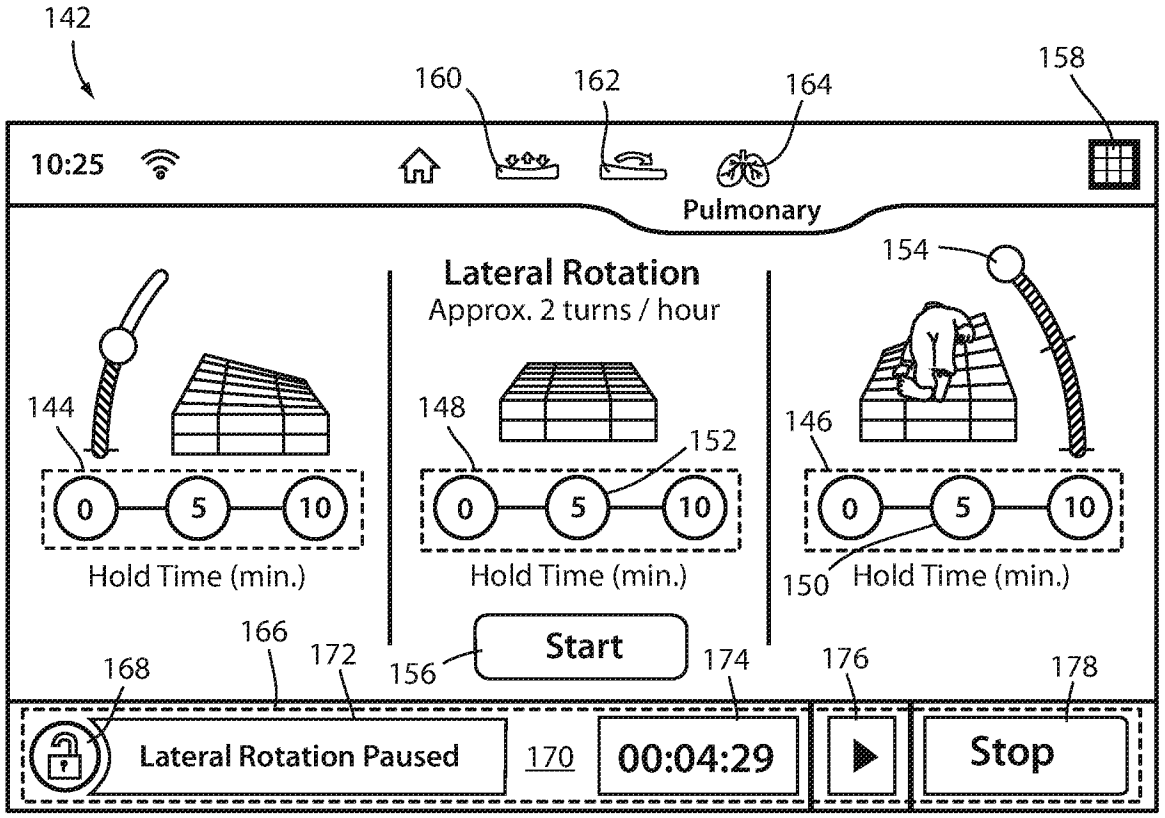
FIG. 6 is the lateral rotation therapy control screen of FIG. 4 modified to show that the lateral rotation therapy is paused.

Upon selection of the pause icon 176, controller 52 updates the status bar 170 to indicate that lateral rotation therapy is paused, as shown in FIG. 6. The update includes pausing or removing the time indication 174 from the status bar 170, changing the color of the status bar 170, changing the text 172 of the status bar 170, or any combination of these. As shown in FIG. 6, the status bar 170 indicates that the lateral rotation therapy function is paused, and includes the time remaining until the end of the therapy function, if resumed. Controller 52 also replaces the pause icon 176 with a resume icon 180 for restarting the lateral rotation therapy function.

Upon selection of the stop icon 178, controller 52 is removes the status bar from the screen 142, i.e. as shown in FIG. 4. Alternatively, upon selection of the stop icon 178, controller 52 updates the status bar 170 to indicate that lateral rotation therapy is stopped, including removing the time indication 174 from the status bar 170, changing the color of the status bar 170, changing the text of the status bar 170, or any combination of these.

Figure 7:
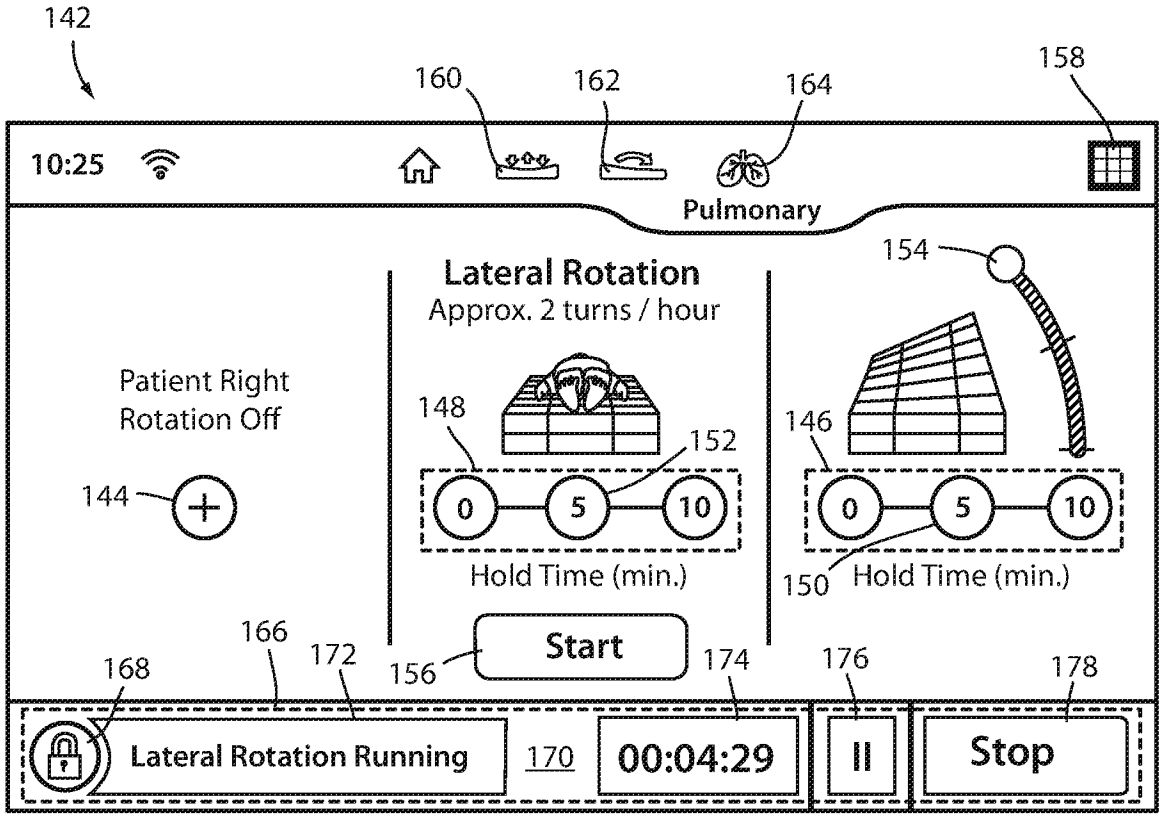
FIG. 7 is the lateral rotation therapy control screen of FIG. 4 modified to show when lateral rotation therapy is in progress and the screen is locked.
Figure 8:
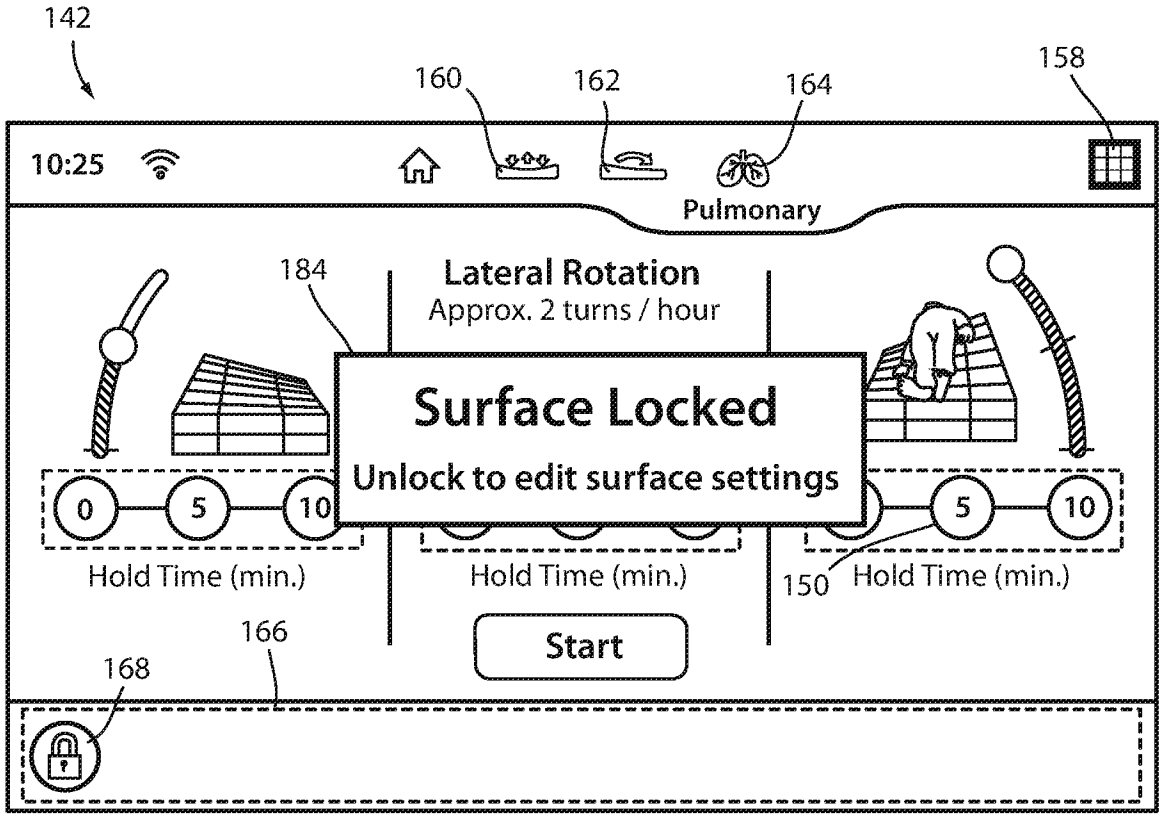
FIG. 8 is an illustrative overlay that may be displayed over, or in lieu, of any of the lateral rotation therapy control screens of FIGS. 4-7.

In FIGS. 4-6, the lock icon 168 is unlocked on the screen 142, such that changes can be made to the rotation program via the controls 144-154. FIG. 7 shows an example of the screen 142 with the lock icon 168 locked, such that changes cannot be made to the currently selected rotation program via the controls 144-154. After user-selection of one of the control icons 144-154, controller 52 is configured to determine if the mattress therapy function settings are locked or unlocked. If controller 52 determines the settings are locked, as in FIG. 7, controller 52 displays an overlay 182 on the screen 142, as shown in FIG. 8. With the lock icon 168 locked, controller 52 also disables the controls 144-154 on the screen 142.

The overlay 182 includes text 184 explaining that the settings are locked, and instructions for unlocking the screen 142 to edit the settings. Advantageously, the overlay 182 is partially transparent such that the screen 142 is at least partially visible under the overlay 182. In FIG. 8, at least a portion of the controls 144-154 are still partially visible under the overlay 182, which provides a visual association between the text and content on the screen 142. Thus, even when the overlay 182 is provided, the user is not dissociated from their current task.

Display of the overlay 182 on screen 142 removes or updates a portion of the banner 166. As shown for FIG. 8, everything but the lock icon 168 is removed by display of the overlay 182. Alternatively, display of the overlay 182 can remove the banner 166 completely.

The lock icon 168 is selectable with the overlay 182 displayed to unlock the settings and permit changes to the rotation program. Upon user-selection of the lock icon 168 on the screen 142 of FIG. 8, controller 52 is configured to remove the overlay 182, and enable the screen 142 and controls 144-154. Touch input anywhere within boundaries of overlay 182 but outside the lock icon 168 on the touchscreen 58 can remove the overlay 182 without unlocking the settings.

Figure 9:
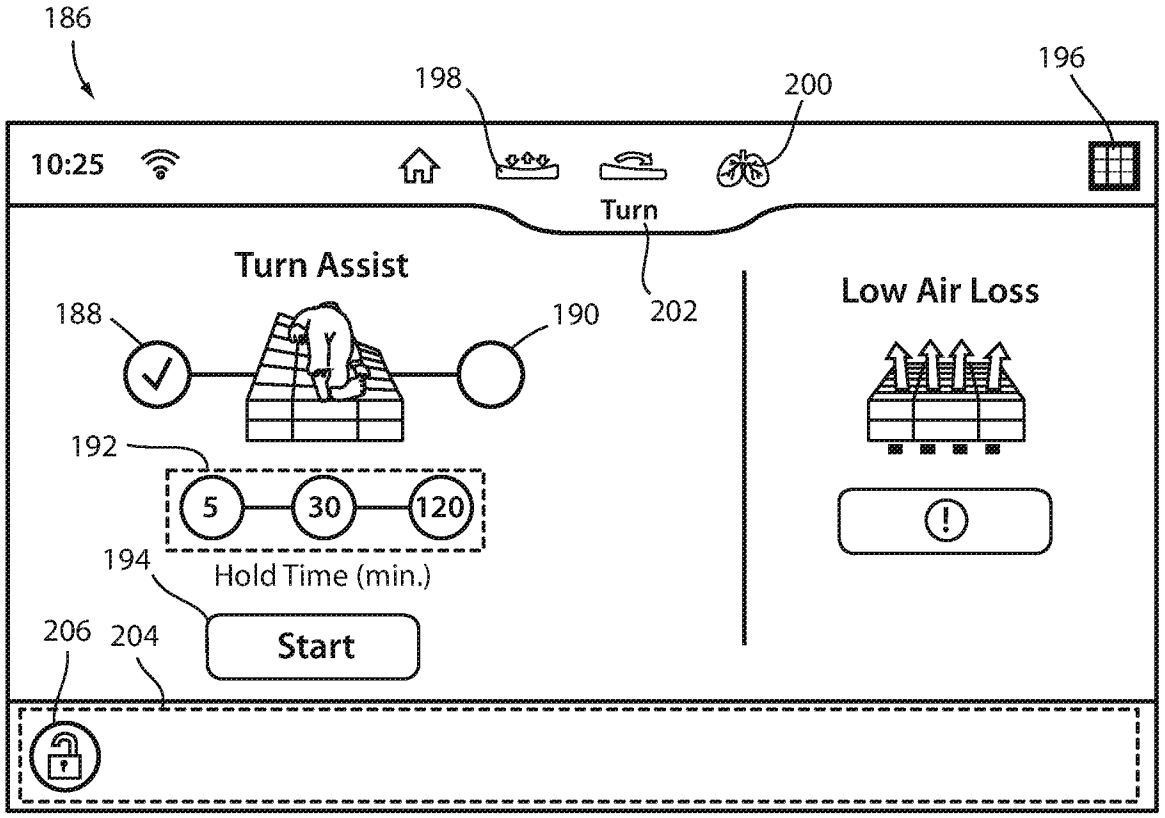
FIG. 9 is an illustrative turn assist control screen that may be displayed on the touchscreen.

Turning to the turn assist feature, when the turn assist control 118 on the menu screen 100 of FIG. 3 is selected, controller 52 displays turn assist control screen 186, shown in FIG. 9, on touchscreen 58. Turn assist control screen 186 is another example of a mattress screen for controlling a mattress therapy function of the mattress 30, specifically for controlling the mattress 30 to turn or rotate a patient supported on the mattress 30 laterally to one side for a period of time to help reposition the patient, such as to prevent bed sores.

The display of turn assist control screen 186 may occur immediately after the turn assist control 118 is pressed, or there may be one or more intermediate controls/screens that need to be followed before getting to turn assist control screen 186. However arrived at, the display of turn assist control screen 186 includes one or more controls for inputting a desired turn, including turn direction, i.e. whether the patient is turned left or right, and the hold time per turn. Specifically, the screen 186 includes a left turn control 188 for selecting a left turn, in which a patient is rotated toward their left, and a right turn control 190 for selecting a right turn, in which a patient is rotated toward their right. As illustrated, the left turn control 188 is selected in FIG. 9. The screen also includes a hold control 192 for selecting the amount of time the patient is held in the turn. As illustrated, the hold time is shown as being set to 30 minutes in FIG. 9.

A start icon 194 is provided on screen 186 for initiating an assisted turn once a desired turn program is set. Based on the settings of the currently selected turn program, controller 52 (FIG. 2) communicates with the mattress controller 94 to operate the at least one blower 98 to inflate and/or deflate one of more of the bladders 96 as needed to carry out the selected turn program, including inflating and/or deflating one of more of the bladders 96 to different air pressures. For example, with the left turn control 188 selected in FIG. 9 as shown, the mattress controller 94 operates the at least one blower 98 to inflate one of more of the bladders 96 corresponding to the patient's right side and/or deflate one of more of the bladders 96 corresponding to the patient's left side as needed to turn the patient toward their left.

The screen 186 includes control icons for non-mattress functions as well, including a menu control 196 for returning to the menu screen 100 (FIG. 3). One or more shortcuts can be provided on the screen 186 to navigate to other mattress screens without having to return to the menu screen 100. In the illustrated embodiment, a pressure redistribution therapy icon 198 and a lateral rotation therapy icon 200 are provided for navigating to screens particular to the associated control, such as the same screens as are displayed in response to activating controls 120 and 116, respectively, on the menu screen 100. An icon 202 representing turn assist is displayed adjacent to the other mattress therapy icons 198, 200, and is particularly displayed in a different color and/or with associated text to indicate to a user that the current screen 186 is for controlling turn assist therapy.

The screen 186 further comprises a banner 204 which selectively indicates the status of the turn assist function and optionally includes one or more controls for turn assist therapy. Prior to initiation of the turn assist, the banner 204 can be absent from the screen 186, or can have fewer icons as shown in FIG. 9. The banner 204 in FIG. 9 includes a lock icon 206 for locking and unlocking at least one setting of the turn assist function, such as all settings of the currently selected turn program, including the currently inputted turn direction and the hold time. As illustrated, the lock icon 206 is unlocked in FIG. 9.

Figure 10:
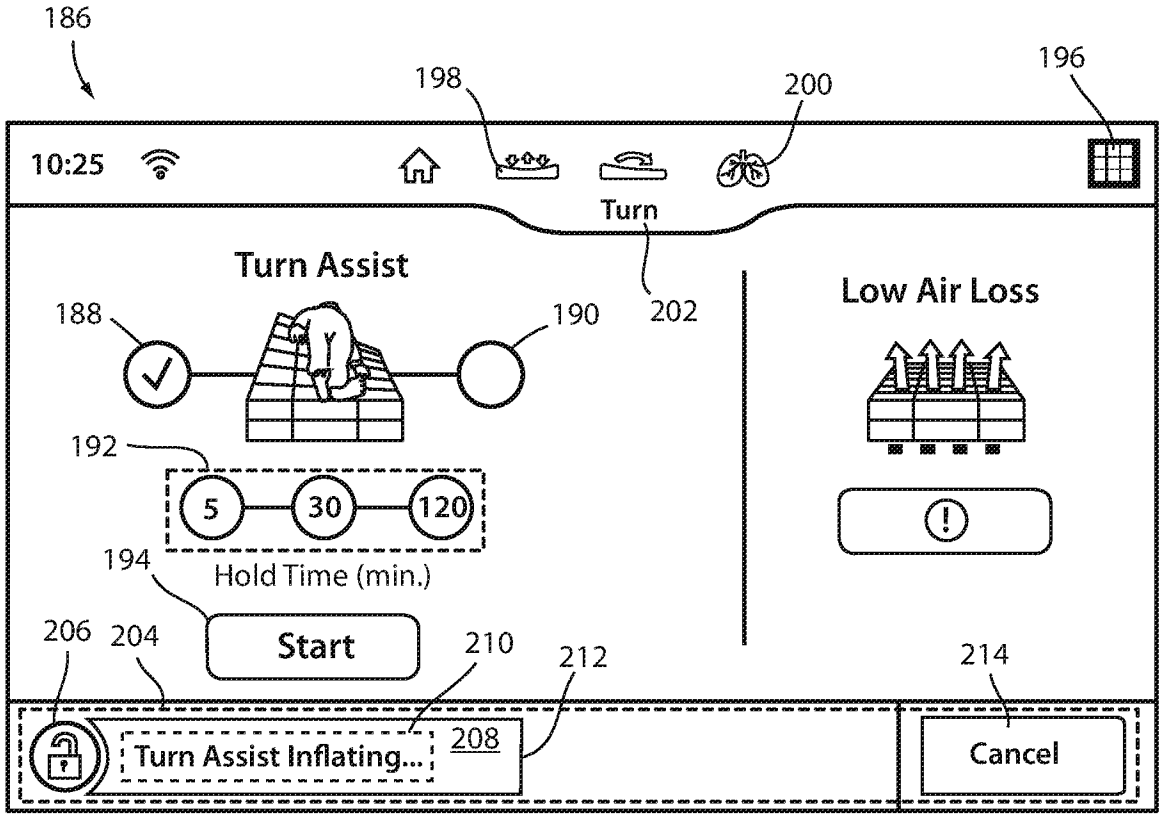
FIG. 10 is the turn assist control screen of FIG. 9 modified to show that the turn assist therapy is in progress.

Upon selection of the start icon 194, controller 52 displays additional information and/or controls on screen 186. As shown in FIG. 10, after turn assist is initiated, the screen 186 includes a status bar 208 indicating the current status of the turn assist therapy. The status bar 208 comprises a graphical element visualizing the status of the function, and further comprises an indication 210 of a name of mattress therapy function being carried out, and an indication 212 of a time remaining for the mattress therapy function (or a time passed since initiation), which is dynamically updated by controller 52 as the therapy function progresses. The indication 212 of the time remaining (or time passed) can be a timed countdown (or count-up), a percent completed, or an animated progress bar, i.e. a graphical element visualizing the progression of the mattress therapy function. As shown in FIG. 10, the status bar 208 indicates that the turn assist function is in progress, specifically that the mattress 30 is inflating to turn the patient, and includes an indication 212 of the time remaining for the inflation in the form of a progress bar.

When the turn assist is in progress or running, the screen 186 includes a cancel or stop icon 214 for stopping the turn assist function. The status bar 208 and stop icon 214 are displayed in the banner 204, along with the lock icon 206. The status bar 208, stop icon 214, and lock icon 206 are juxtaposed within the banner 204, with the lock icon 206 on one end, the stop icon 214 on the opposite end, and the status bar 208 in between the lock icon 206 and the stop icon 214.

The banner 204 is displayed at the bottom of the screen 186. Spacing the banner 204 from the control icons 196, 198, 200 unrelated to the turn assist function can prevent the user from accidentally navigating away from the screen 186 when attempting to lock or stop the therapy, and likewise can prevent changes to the therapy in progress when attempting to navigate to another screen. Alternatively, the banner 204 can be displayed at the top of the screen 186 or along one side of the screen 186.

The color of the status bar 208 provides a visual indication of the current status of turn assist function on the touchscreen 58. The status bar 208 is displayed in one color when the turn assist function is in progress or running, as shown in FIG. 10, and is displayed in a different color (not shown) when the turn assist function is stopped.

Upon selection of the stop icon 214, controller 52 removes the status bar from the screen 186, i.e. as shown in FIG. 9. Alternatively, upon selection of the stop icon 214, controller 52 updates the status bar 208 to indicate that turn assist therapy is stopped, including removing the time indication 212 from the status bar 208, changing the color of the status bar 208, such as changing the color of the time indication 212 or progress bar, changing the text of the status bar 208, or any combination of these.

In FIGS. 9-10, the lock icon 206 is unlocked on the screen 186, such that changes can be made to the turn program via the controls 188, 190, 192. Upon selection of the lock icon 206, changes cannot be made to the currently selected turn program via the controls 188, 190, 192. After user-selection of one of the control icons 188, 190, 192, controller 52 is configured to determine if the mattress therapy function settings are locked or unlocked. If controller 52 determines the settings are locked, controller 52 displays an overlay (not shown) on the screen 186. With the lock icon 206 locked, controller 52 also disables the controls 188, 190, 192 on the screen 186. While not shown herein, the overlay for the turn assist control screen 186 can be substantially similar or identical to the overlay 182 described above with reference to FIG. 8 for the lateral rotation control screen 142, with appropriate modifications for the turn assist therapy.

When the position control 112 on the user interface 48 of FIG. 3 is selected, controller 52 displays position control screen 216, shown in FIG. 11, on touchscreen 58. Position control screen 216 is one example of a patient support apparatus screen for controlling a non-mattress function of the patient support apparatus 10, specifically for controlling the position of at least one component of the patient support apparatus 10, such as one or more of the litter frame 16 or the support deck 18.

The display of screen 216 may occur immediately after the position control 112 is pressed, or there may be one or more intermediate controls/screens that need to be followed before getting to screen 216. However arrived at, the display of position control screen 216 includes at least one control icon for controlling the position of at least one component of the patient support apparatus 10, such as one or more of the litter frame 16 or the support deck 18. As shown herein, the position control screen 216 includes a control icon 218 for raising the head section 20 of the support deck 18, a control icon 220 for lowering the head section 20 of the support deck 18, a control icon 222 for raising the foot section 26 of the support deck 18, a control icon 224 for lowering the foot section 26 of the support deck 18, a control icon 226 for raising the litter frame 16, a control icon 228 for lowering the litter frame 16, a one-touch control icon 230 for moving the support deck 18 to a flat position, a one-touch control icon 232 for moving the support deck to a Fowler's position, a one-touch control icon 234 for moving the support deck 18 to a Trendelenburg position, and a one-touch control icon 236 for moving the support deck 18 to a reverse Trendelenburg position. While not shown, individual controls for raising and lowering the thigh section 24 of the support deck 18 can be provided on screen 216.

In particular, the control icons can operate one or more of the actuators 64, 70, 72, 74 (FIG. 2) adapted to move a component of the patient support apparatus 10. As shown herein, selection of the control icon 218 operates the head section actuator 70 to raise the head section 20 of the support deck 18; selection of the control icon 220 operates the head section actuator 70 to lower the head section 20 of the support deck 18; selection of the control icon 222 operates the foot section actuator 74 to raise the foot section 26 of the support deck 18; selection of the control icon 224 operates the foot section actuator 74 to lower the foot section 26 of the support deck 18; selection of the control icon 226 operates the lift actuator(s) 64 to raise the litter frame 16; selection of the control icon 228 operates the lift actuator(s) 64 to lower the litter frame 16; and selection of one of the control icons 230, 232, 234, 236 operates one or more of the actuators 64, 70, 72, 74 (depending on the current position of the support deck 18) to move the support deck 18 to a flat position, a Fowler's position, a Trendelenburg position, or a reverse Trendelenburg position, respectively.

The position control screen 216 includes other control icons as well, including a position lock control 238 for locking the current position settings so that the position settings cannot be changed on other screens, a wheel lock control 240 for locking the wheels 42, and a menu control 242 for returning to the menu screen 100 (FIG. 3). One or more shortcuts can be provided on the screen 216 to navigate to other screens without having to return to the menu screen 100. In the illustrated embodiment, a scale control 244, a bed alarm control 246, and a bed monitor control 248 are provided for navigating to screens particular to the associated control, and are touchscreen duplicates of the non-touchscreen controls 110, 104, and 106, respectively.

The position control screen 216 includes at least one therapy icon 250, 252, 254 indicating a status of a mattress therapy function, which is controllable from a different screen, such as a mattress therapy screen, displayable on the touchscreen 58. Examples of mattress therapy screens include at least the lateral rotation control screen 142 and the turn assist control screen 186. Additional mattress therapy screens include one or more of the following: an alternating pressure therapy control screen, a percussion therapy control screen, a vibration therapy control screen, and a pressure redistribution therapy control screen. Examples of a status of a mattress therapy function include at least whether the mattress therapy function is in progress, paused, stopped, has not been initiated, has encountered an error, or requires user input. The therapy icons on the position control screen 216 shown in FIG. 11 include a lateral rotation therapy icon 250 indicating a status of a lateral rotation therapy function, a turn assist therapy icon 252 indicating a status of a turn assist therapy function, and a pressure redistribution icon 254 indicating a status of a pressure redistribution function. In the embodiment of the position control screen 216 shown in in FIG. 11, the lateral rotation therapy icon 250 indicates that a lateral rotation therapy function is paused and the turn assist therapy icon 252 indicates that a turn assist therapy function is in progress.

The status of the mattress therapy function can be communicated visually to the user by the therapy icon 250, 252, 254, such as by color, symbols, and/or text. The therapy icons 250, 252, 254 optionally include a status indicator displaying the status of the mattress therapy function corresponding to the therapy icon. The status indicator can be displayed in a different color and/or with a different symbol or associated text to communicate the status of the mattress therapy function to the user, such as whether the mattress therapy function is in progress or paused. Other visual displays for communicating the status of the mattress therapy function are also possible. As illustrated in FIG. 11, a status indicator 256 for the lateral rotation therapy icon 250 indicates that lateral rotation therapy is paused and a status indicator 258 for the turn assist therapy icon 252 indicates that turn assist therapy is in progress. The paused status indicator 256 is displayed in orange with a pause symbol and the in-progress status indicator 258 is displayed in green with a triangle symbol. Other status indicators for communicating an in-progress or paused mattress therapy function are also possible.

Prior to initiation of a mattress therapy or when a mattress therapy is stopped, the status indicator is absent from the therapy icon. An example of this is shown in FIG. 11 for pressure redistribution icon 254, which does not comprise a status indicator. The absence of a status indicator communicates to the user that pressure redistribution function is stopped or has not been initiated. Alternatively, prior to initiation of a mattress therapy or when a mattress therapy is stopped, the status indicator can be displayed, but in a different color and/or with a different symbol or associated text to communicate this to the user. For example, the status indicator can be displayed in red and/or with a square symbol when a mattress therapy is stopped or has not been initiated. Other status indicators for communicating a stopped mattress therapy function are also possible.

The position control screen 216 does not include any controls or inputs operable to change any settings of the mattress therapy function(s) corresponding to the therapy icons 250, 252, 254. In order to change one or more settings of a mattress therapy function, the user navigates to an appropriate mattress therapy screen. Advantageously, the therapy icons 250, 252, 254 themselves can be selected to navigate to a mattress therapy screen which includes one or more control icons for controlling the mattress therapy function, such as to change one or more settings of the mattress therapy function. After user-selection of one of the therapy icons 250, 252, 254 on the position control screen 216, controller 52 displays a mattress screen for controlling a mattress therapy function corresponding to the selected therapy icon 250, 252, 254. The therapy icons 250, 252, 254 thereby provide shortcuts to navigate to other mattress screens without having to return to the menu screen 100.

The therapy icons 250, 252, 254 representing lateral rotation therapy, turn assist therapy, and pressure redistribution therapy, respectively, are displayed adjacent to each other at a top of the position control screen 216. Spacing the therapy icons 250, 252, 254 from the control icon for controlling the position of at least one component of the patient support apparatus 10, i.e. the litter frame 16 or the support deck 18, can prevent the user from accidentally navigating away from the screen 216 when attempting to change the position of the apparatus 10, and likewise can prevent changes to the current position of the apparatus 10 when attempting to navigate to a mattress screen via the therapy icons 250, 252, 254. Alternatively, the therapy icons 250, 252, 254 can be displayed at the bottom of the screen 216 or along one side of the screen 216.

Controller 52 is configured to display the therapy icons 250, 252, 254 on additional patient support apparatus screens for controlling additional non-mattress functions of the patient support apparatus 10. One example of such a screen is shown in FIG. 12 and comprises a scale screen 260. When either of the scale control 110 on the user interface 48 of FIG. 3 or scale control 122 on the touchscreen 58 of FIG. 3 is selected, controller 52 displays scale screen 260, shown in FIG. 12, on touchscreen 58. The display of scale screen 260 may occur immediately after the scale control 110 or 122 is pressed, or there may be one or more intermediate controls/screens that need to be followed before getting to scale screen 260. However arrived at, the display of scale screen 260 includes an indicator 262 of the patient's weight, as determined by the scale/exit detection system 82, i.e. the force sensors 84, and a save weight icon 264 used to store the patient's weight reading. The scale screen 260 also includes the therapy icons 250, 252, 254 indicating a status of a mattress therapy function, as described above with reference to FIG. 11.

When the pressure redistribution therapy icon 254 on the position control screen 216 (FIG. 11) or the scale screen 260 (FIG. 12) is selected, controller 52 displays a pressure redistribution control screen (not shown) on touchscreen 58, which includes control inputs for operating the mattress 30 in a pressure redistribution mode. The display of the pressure redistribution control screen may occur immediately after the pressure redistribution therapy icon 254 is pressed, or there may be one or more intermediate controls/screens that need to be followed before getting to the pressure redistribution control screen. The pressure redistribution control screen can include at least one therapy icon indicating a status of another mattress therapy function, which is controllable from a different screen.

Figure 13:
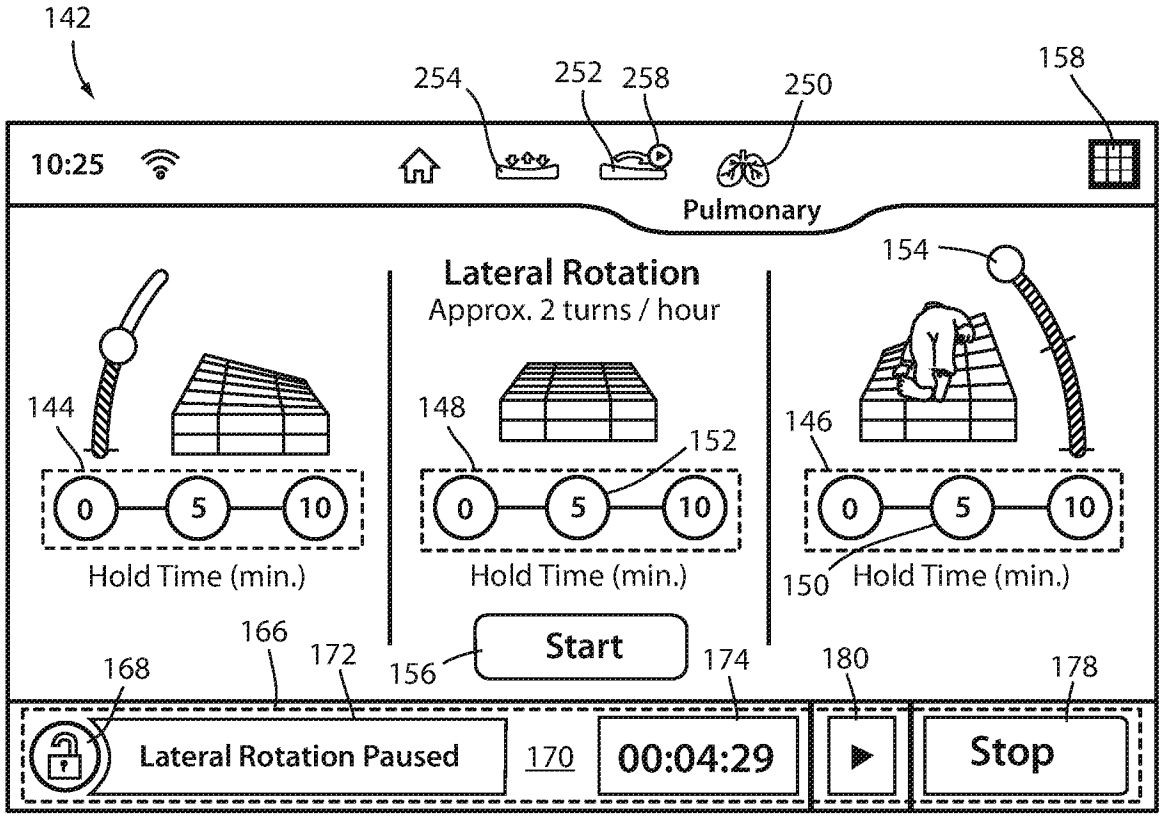
FIG. 13 is the lateral rotation therapy control screen of FIG. 4 modified to show a therapy icon indicating a status of another mattress therapy function.

When the lateral rotation therapy icon 250 on the position control screen 216 (FIG. 11) or the scale screen 260 (FIG. 12) is selected, controller 52 displays lateral rotation control screen 142 on touchscreen 58, as shown in FIG. 13. The display of screen 142 may occur immediately after the lateral rotation therapy icon 250 is pressed, or there may be one or more intermediate controls/screens that need to be followed before getting to screen 142.

The lateral rotation control screen 142 includes at least one therapy icon indicating a status of another mattress therapy function, which is controllable from a different screen. As shown in FIG. 13, the screen 142 includes the turn assist therapy icon 252 indicating the status of a turn assist therapy function (which is in progress, as indicated by turn assist indicator icon 258) and the pressure redistribution therapy icon 254 indicating the status of a pressure redistribution therapy function. The screen 142 also includes the lateral rotation therapy icon 250, which is displayed in a different color, optionally with text as shown, or otherwise visually distinguished from the other therapy icons 252, 254 to indicate to the user that the current screen 142 is for controlling lateral rotation therapy.

Figure 14:
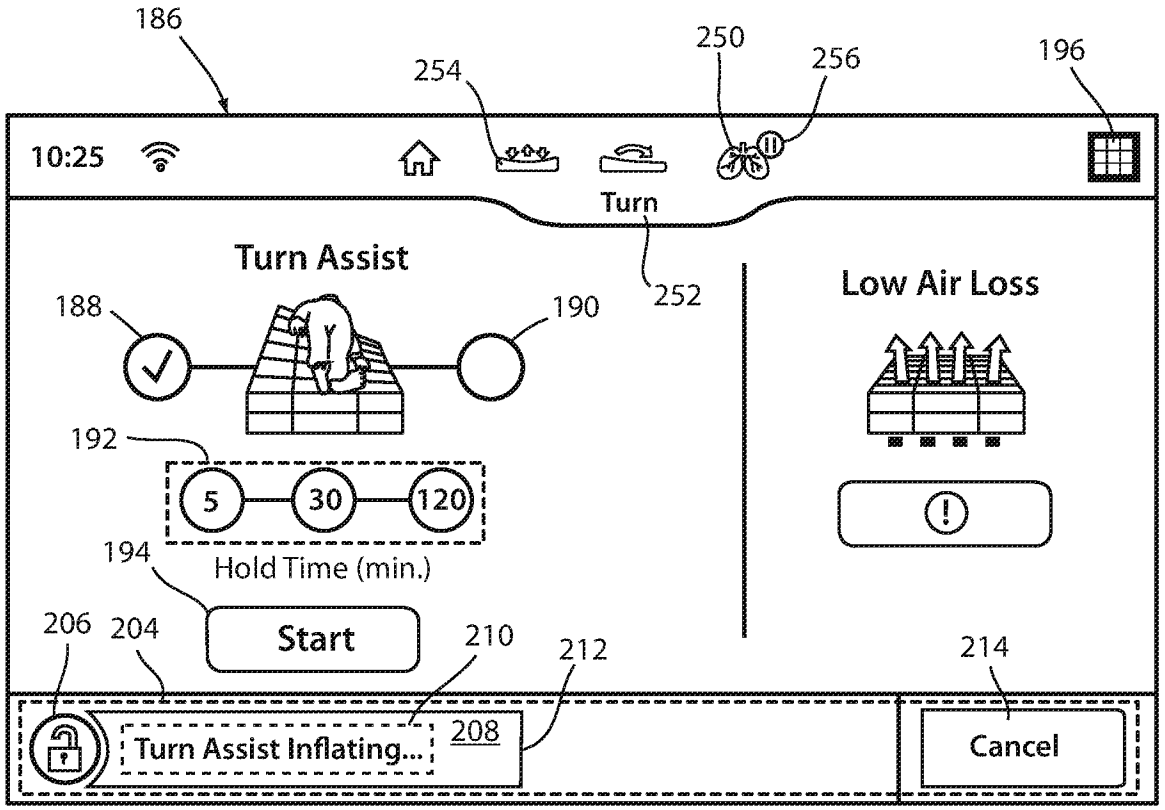
FIG. 14 is the turn assist control screen of FIG. 9 modified to show a therapy icon indicating a status of another mattress therapy function.

When the turn assist therapy icon 252 on the position control screen 216 (FIG. 11) or the scale screen 260 (FIG. 12) is selected, controller 52 displays turn assist control screen 186 on touchscreen 58, as shown in FIG. 14. The display of screen 186 may occur immediately after the turn assist therapy icon 252 is pressed, or there may be one or more intermediate controls/screens that need to be followed before getting to screen 186.

The turn assist control screen 186 includes at least one therapy icon indicating a status of another mattress therapy function, which is controllable from a different screen. As shown in FIG. 14, the screen 186 includes the lateral rotation therapy icon 250 indicating the status of a lateral rotation therapy function and the pressure redistribution therapy icon 254 indicating the status of a pressure redistribution therapy function (which is currently paused, as indicated by lateral rotation status indicator 256). The screen 186 also includes the turn assist therapy icon 252, which is displayed in a different color, size, and/or with associated text, or otherwise visually distinguished from the other therapy icons 252, 254 to indicate to the user that the current screen 186 is for controlling turn assist therapy.

Figure 15:
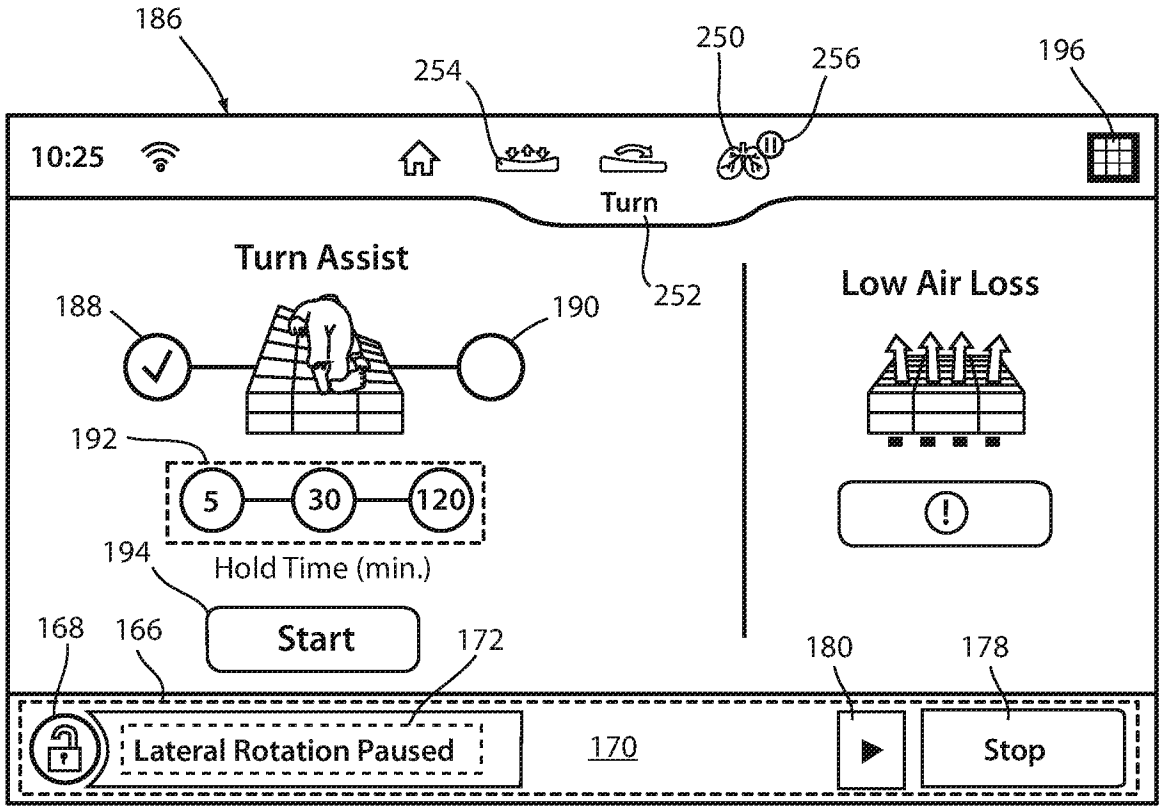
FIG. 15 is the turn assist control screen modified to show when lateral rotation therapy is paused.

The turn assist control screen 186 optionally displays further information regarding the status of the other mattress therapy functions and/or one or more control icons for controlling the other mattress therapy functions. In one embodiment, upon selection of the lateral rotation therapy icon 250, or more specifically upon selection of the status indicator 256 for the lateral rotation therapy icon 250 (or in other embodiments, automatically upon the display of turn assist control screen 186), controller 52 updates the turn assist control screen 186 with the lateral rotation therapy banner 166 as shown in FIG. 15, which selectively indicates the status of the lateral rotation therapy function and optionally includes one or more controls for lateral rotation therapy, as described above with reference to FIGS. 4-8. Prior to selection of the lateral rotation therapy icon 250 or the status indicator 256 for the lateral rotation therapy, the turn assist banner 204 for turn assist therapy can also be displayed on the turn assist control screen 186, as shown in FIG. 14. While not explicitly described herein, the other mattress therapy screens disclosed herein can similarly display further information regarding the status of the other mattress therapy functions and/or one or more control icons for controlling the other mattress therapy functions.

In some embodiments, the turn assist control screen 186 does not include any controls or inputs operable to change any settings of the lateral rotation therapy function. In other embodiments, such as the embodiment shown in FIG. 15, the turn assist control screen 186 has one or more controls or inputs via which the settings of the lateral rotation therapy function can be changed, such as the stop icon 178 for stopping the lateral rotation therapy function, resume icon 180 for restarting the lateral rotation therapy function, and the lock icon 168 for locking and unlocking at least one setting of the lateral rotation therapy function. Banner 166 thereby provide shortcuts to change one or more settings of the lateral rotation therapy function without having to navigate to the lateral rotation control screen 142.

Figure 16:
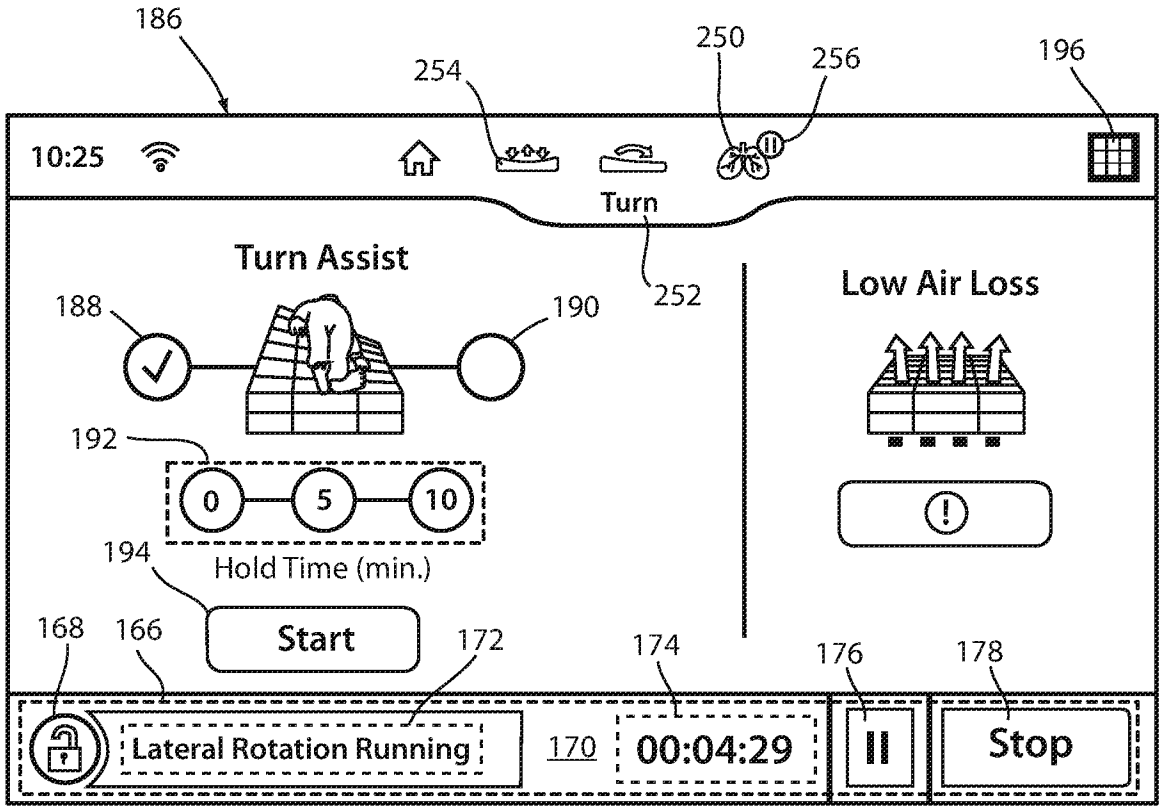
FIG. 16 is the turn assist control screen modified to include one or more controls for lateral rotation therapy when lateral rotation therapy is in progress.

In one example, from the turn assist control screen 186, after user-selection of the resume icon 180 for restarting the lateral rotation therapy function, controller 52 restarts the lateral rotation therapy function. Upon restarting the lateral rotation therapy function, the turn assist control screen 186 is replaced with the lateral rotation control screen 142, or, as shown in FIG. 16, controller 52 maintains the display of turn assist control screen 186 and updates the lateral rotation therapy status bar 170 to indicate that lateral rotation therapy has resumed, including adding the time indication 174, changing the color of the status bar 170, changing the text 172, replacing the resume icon 180 with a pause icon 176, or any combination of these.

Controller 52 disables the start icon 194 for initiating an assisted turn on the turn assist control screen 186 until the lateral rotation therapy function is paused or stopped, i.e. while the lateral rotation therapy function is in progress. This prevents simultaneously performance of the turn assist and lateral rotation therapy functions. Upon selection of the start icon 194, while the lateral rotation therapy function is in progress, controller 52 can display an overlay (not shown) on the screen 186 which can include text explaining that the lateral rotation therapy function is in progress, and instructions for pausing or stopping the lateral rotation therapy in order to start an assisted turn. Upon selection of the stop icon 178 or pause icon 180 on screen 186 to stop or pause lateral rotation therapy, controller 52 can enable the start icon 194 for initiating an assisted turn.

Alternatively, controller 52 can disable the start icon 194 for initiating an assisted turn on the turn assist control screen 186 until the lateral rotation therapy function is stopped. This prevents performance of initiating an assisted turn while the lateral rotation therapy function is in progress or paused. Upon selection of the stop icon 178 on screen 186 to stop lateral rotation therapy, controller 52 can enable the start icon 194 for initiating an assisted turn.

After user-selection of the stop icon 178 on screen 186 to stop lateral rotation therapy, controller 52 updates the status bar 170 to indicate that lateral rotation therapy is stopped. The update includes removing the status bar 170 or other information regarding the status of the lateral rotation therapy from the screen 186, pausing or removing the time indication 174 from the status bar 170, changing the color of the status bar 170, changing the text 172 of the status bar 170, or any combination of these. For instance, after pressing the stop icon 178 to stop lateral rotation therapy, the lateral rotation therapy banner 166 can be removed from screen 186, and optionally replaced with the turn assist banner 204, as shown in FIG. 14, or another status bar indicating the status of the turn assist function.

After user-selection of the pause icon 178 on screen 186 to pause lateral rotation therapy, controller 52 updates the status bar 170 to indicate that lateral rotation therapy is paused. The update includes pausing or removing the time indication 174 from the status bar 170, changing the color of the status bar 170, changing the text 172 of the status bar 170, or any combination of these. In the embodiment shown, after user-selection of the pause icon 178 as shown in FIG. 16, controller 52 removes a time from the status bar 170 as shown in FIG. 15, and can also update the status bar 170 to indicate that lateral rotation therapy is paused. Alternatively, after pressing the pause icon 178 to pause lateral rotation therapy, the lateral rotation therapy banner 166 can be removed from screen 186, and optionally replaced with the turn assist banner 204, as shown in FIG. 9 or FIG. 14, or another status bar indicating the status of the turn assist function.

To the extent not already described, the different content and functions of the various control screen of patient support apparatus 10 may be used in combination with each other as desired, and/or the content and/or functions of one control screen may be applied to one or more other control screen. Further, the selected content shown in any particular control screen herein is not to be construed that it must have all of the content shown therein. For example, embodiments including the notification of a mattress therapy function status on a patient support apparatus screen for controlling a non-mattress function of the patient support apparatus (e.g., FIGS. 11-12), the notification of a first mattress therapy function status on a mattress screen for controlling a second mattress therapy function (e.g., FIGS. 13-15), and the provision of a banner comprising status information and controls for a mattress therapy function (e.g., FIGS. 4-10)

can be implemented independently of each other or in any sub-combination on the patient support apparatus 10. Likewise, the lift system 62, articulation system 68, scale/exit detection system 82, and mattress 30 can be provided independently of each other or in any sub-combination on the patient support apparatus 10.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A patient support apparatus comprising:

a litter frame;

a support deck supported on the litter frame and adapted to support a mattress thereon;

an actuator adapted to move a component of the patient support apparatus, wherein the component is one of the litter frame or the support deck;

a touchscreen; and a controller configured to display on the touchscreen:

a mattress screen for controlling a mattress therapy function, the mattress screen including a start icon for initiating the mattress therapy function; and a patient support apparatus screen for controlling a non-mattress function of the patient support apparatus, the patient support apparatus screen being different from the mattress screen, the patient support apparatus screen including a control icon for operating the actuator to move the component and a therapy icon indicating a status of the mattress therapy function.

2. The patient support apparatus of claim 1 wherein the patient support apparatus screen includes no controls for changing a setting of the mattress therapy function, and wherein the mattress screen further includes at least one of a pause icon for pausing the mattress therapy function and a stop icon for stopping the mattress therapy function.

3. The patient support apparatus of claim 1 wherein the status of the mattress therapy function indicates whether the mattress therapy function is in progress or paused; and wherein the controller is configured to display additional patient support apparatus screens for controlling additional non-mattress functions of the patient support apparatus, and wherein the additional patient support apparatus screens include the therapy icon indicating the status of the mattress therapy function.

4. The patient support apparatus of claim 1 wherein the therapy icon is a first therapy icon indicating a status of a first mattress therapy function, and the patient support apparatus screen includes a second therapy icon indicating a status of a second mattress therapy function.

5. The patient support apparatus of claim 4 wherein the mattress screen is a first mattress screen for controlling the first mattress therapy function, and the controller is further configured to display a second mattress screen for controlling the second mattress therapy function, wherein the first therapy icon is displayed on the second mattress screen and the second therapy icon is displayed on the first mattress screen, and wherein the first mattress therapy function is lateral rotation function and the second mattress therapy function is turn assist function.

6. The patient support apparatus of claim 5, wherein the controller is configured to display the first therapy icon in a first color and the second therapy icon in a second color on the first mattress screen, and the controller is configured to display the first therapy icon in the second color and the second therapy icon in the first color on the second mattress screen.

7. The patient support apparatus of claim 1 wherein the mattress screen further comprises a banner comprising a status bar indicating the status of the mattress therapy function and a stop icon for stopping the mattress therapy function, and wherein the banner further comprises a lock icon for locking and unlocking a setting of the mattress therapy function, the lock icon further indicating whether the setting is currently locked or unlocked; and wherein banner still further comprises a pause icon for pausing the mattress therapy function.

8. A patient support apparatus comprising:

a litter frame;

a support deck supported on the litter frame and adapted to support a mattress thereon;

a touchscreen; and a controller configured to display on the touchscreen:

a first mattress screen for controlling a first mattress therapy function, the first mattress screen including a first start icon for initiating the first mattress therapy function; and a second mattress screen for controlling a second mattress therapy function, the second mattress screen different from the first mattress screen and including a second start icon for initiating the second mattress therapy function;

wherein, after user-selection of the first start icon to initiate the first mattress therapy function, the controller is operable to display a status bar indicating a status of the first mattress therapy function on the second mattress screen.

9. The patient support apparatus of claim 8 wherein the first mattress therapy function is lateral rotation function and the second mattress therapy function is turn assist function, and wherein the status bar comprises a name of first mattress therapy function and time remaining for the first mattress therapy function.

10. The patient support apparatus of claim 8 wherein the status bar is provided in a banner across a bottom of the screen, and wherein the banner further comprises a stop icon for stopping the first mattress therapy function and a lock icon for locking and unlocking a setting of the first mattress therapy function, the lock icon further indicating whether the setting is currently locked or unlocked.

11. The patient support apparatus of claim 10 wherein the second mattress screen includes a control icon for controlling the first mattress therapy function, and at least one of a pause icon for pausing the first mattress therapy function or a stop icon for stopping the first mattress therapy function.

12. The patient support apparatus of claim 11 wherein after user-selection of the stop icon to stop the first mattress therapy function, the controller is operable to remove at least one of the status bar from the second mattress screen or a time from the status bar.

13. The patient support apparatus of claim 11 wherein after user-selection of the stop icon to stop the first mattress therapy function or the pause icon to pause the first mattress therapy function, the controller is operable to change at least one of a color of the status bar or a text of the status bar.

14. The patient support apparatus of claim 8 wherein the controller is operable to display a therapy icon for switching to the first mattress screen on the second mattress screen, wherein, after user-selection of the therapy icon on the second mattress screen, the controller is operable to display the first mattress screen.

15. The patient support apparatus of claim 8 wherein the controller is configured to display a patient support apparatus screen for controlling a non-mattress function of the patient support apparatus, the patient support apparatus screen includes a first therapy icon indicating a status of the first mattress therapy function, and wherein the patient support apparatus screen further includes a second therapy icon indicating a status of the second mattress therapy function, and wherein the patient support apparatus screen comprises a control icon for operating an actuator an actuator adapted to move one of the litter frame or the support deck.

16. A patient support apparatus comprising:

a litter frame;

a support deck supported on the litter frame and adapted to support a mattress thereon;

a touchscreen; and a controller configured to display a first mattress therapy screen on the touchscreen for controlling a first mattress therapy function, the first mattress therapy screen comprising:

a start icon for initiating the first mattress therapy function; and a banner comprising a status bar indicating a status of the first mattress therapy function, a stop icon for stopping the first mattress therapy function, and a lock icon for locking and unlocking a setting of the first mattress therapy function, the lock icon further indicating whether the setting is currently locked or unlocked;

wherein the controller is further configured, if the first mattress therapy function has started, to continue to display the banner on a second mattress therapy screen, the second mattress therapy screen including a start icon for starting a second mattress therapy function and a setting icon for changing a setting of the second mattress therapy function, the second mattress therapy function being different from the first mattress therapy function.

17. The patient support apparatus of claim 16 wherein the lock icon is displayed at a first end of the status bar and the stop icon is displayed at a second end of the status bar.

18. The patient support apparatus of claim 16 wherein the first mattress therapy function is assisting turning of a patient, the first mattress therapy screen includes a hold control for selecting how long the patient is held in a turn, and the first mattress therapy screen further includes a turn direction control for selecting a direction in which the patient is turned.

19. The patient support apparatus of claim 16 wherein the status bar comprises at least one of the following: an indication of a time remaining for the first mattress therapy function; a name of the first mattress therapy function; or an indication of whether the first mattress therapy function is running or paused.

20. The patient support apparatus of claim 16 wherein the controller is configured to display the banner across a bottom of the first mattress therapy screen, and wherein the status bar, stop icon, and lock icon are juxtaposed within the banner.

* * * * *